US006548148B1

(12) United States Patent
Torii et al.

(10) Patent No.: US 6,548,148 B1
(45) Date of Patent: Apr. 15, 2003

(54) THERMAL TRANSFER FILM AND IMAGE FORMING METHOD

(75) Inventors: Masanori Torii, Tokyo-to (JP); Mitsuru Maeda, Tokyo-to (JP); Fumihiko Mizukami, Tokyo-to (JP); Shigeki Chujo, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/540,271

(22) Filed: Mar. 31, 2000

(30) Foreign Application Priority Data

| | | |
|---|---|---|
| Apr. 2, 1999 | (JP) | 11-096115 |
| Apr. 26, 1999 | (JP) | 11-118695 |
| Jan. 18, 2000 | (JP) | 12-008741 |

(51) Int. Cl.[7] ..... B41M 5/30

(52) U.S. Cl. ..... 428/195; 156/235

(58) Field of Search ..... 428/195, 484, 428/488.1, 488.4, 913, 914, 475.5; 156/235

(56) References Cited

U.S. PATENT DOCUMENTS 4,882,218 A * 11/1989 Koshizuka et al. ..... 428/216

* cited by examiner

*Primary Examiner*—Bruce H. Hess
(74) *Attorney, Agent, or Firm*—Ladas & Parry

(57) ABSTRACT

The present invention is for providing a thermal transfer film capable of providing a vivid print without generation of a void, and an image forming method using the same. The thermal transfer film comprises a coloring layer formed on a substrate film via an intermediate layer, wherein the intermediate layer comprises materials according to either one of the following combinations: (1) a polycaprolactone resin having a 100–1,000 mPa·s melt viscosity at 75° C., and a binder resin having a 130–400° C. extrapolation fuse starting temperature; (2) a thermally fusible substance having a 100–1,000 mPa·s melt viscosity at 75° C., and a binder resin having a 150–400° C. extrapolation fuse starting temperature, (3) a polycaprolactone resin having a 100–1,000 mPa·s melt viscosity at 75° C., and a non-transferable binder resin having a 130–400° C softening temperature; and (4) a thermally fusible substance having a 100–1,000 mPa·s melt viscosity at 75° C., and a non-transferable binder resin having a 130–400° C. softening temperature.

27 Claims, 1 Drawing Sheet

THERMAL TRANSFER FILM AND IMAGE FORMING METHOD

BACKGROUND OF THE INVENTION

1. Field of the Invention

The present invention relates to a thermal transfer film having a coloring layer provided on a substrate film via an intermediate layer, more specifically, it relates to a thermal transfer film capable of providing a vivid print without generation of a void in a printed product, capable of applying preferably and stably the intermediate layer and the coloring layer to be formed on the substrate film, and further, having a classification leakage preventing function, and an image forming method using the same.

2. Description of the Related Art

Conventionally, as a thermal transfer recording medium to be used in a thermal transfer printer, a facsimile, or the like, a thermal transfer film provided with a coloring layer made from a thermally fusible ink on one surface of the substrate film has been used.

Conventional thermal transfer films have been produced by using a paper such as a condenser paper and a paraffin paper of about 10 to 20 $\mu$m thickness, or a plastic film such as polyester and cellophane of about 3 to 20 $\mu$m thickness as the substrate film, and applying a thermally fusible ink prepared by mixing a coloring agent such as a pigment and a dye to a binder, and optionally an additive such as a melting point lowering agent and a plasticizer onto the substrate film so as to provide a coloring layer. Moreover, some of the thermal transfer films comprise an intermediate layer between the substrate film and the coloring layer, adjusted so as to be fused by the energy of printing.

By heating and pressing a predetermined portion by a thermal head from the rear side of the substrate film, the coloring layer at a position corresponding to the printing part is fused so as to be transferred onto the transfer receiving material.

However, in the case of printing with the conventional thermal transfer film comprising the intermediate layer and the thermally fusible coloring layer provided on the substrate film, problems are involved in that the printed product can be blurred due to lack of characters or fine lines caused by a generated void and that the peeling sound generated at the time of peeling the thermal transfer film from the transfer receiving material is noisy. In order to print on a paper with a rough texture having a 50 seconds or less beck smoothness without generating a void, it is necessary to transfer the region of the coloring layer with the energy applied like pixels by means of a thermal head onto the receiving paper without generating a void (without remaining on the intermediate layer). In order to transfer the coloring layer entirely without generating a void in the receiving paper, it is effective to peel off the receiving paper and the thermal transfer film when the intermediate layer of the thermal transfer film provided with the coloring layer on the substrate film via the intermediate layer is melted so as to be in the liquid state with a high flowability. However, in equipments commonly used presently, such as a facsimile using a thermal transfer film, since there is a time interval between the moment when the printing energy is applied to the thermal transfer film after superimposing the transfer receiving material and the thermal transfer film and the moment when the thermal transfer film is peeled off from the transfer receiving material, even if an intermediate layer adjusted so as to be fused by the energy for printing is used, in general, it is cooled and aggregated again in the interval, or even if it is not aggregated, it is in the state with a low flowability.

Substances with the so-called supercooling property, having a freezing point lower than the melting point by 10° C. or more have been known in various articles. Techniques concerning the thermal transfer film provided with a coloring layer on a substrate film via an intermediate layer using various substances having the supercooling property have been known. Examples thereof include Japanese Patent Application Laid-Open (JP-A) Nos. 61-235189, 61-286195, 62-9991, 62-82084, 63-302090, and 3-246094. In contrast, polycaprolactone resins having the supercooling property have been known in various articles. Techniques concerning the thermal transfer film provided with a coloring layer containing the polycaprolactone resin on the substrate film have been known. Examples thereof include Japanese Patent Application Laid-Open (JP-A) Nos. 59-230795, 60-122194, 60-122195, 61-185492, 62-59089, and 5-32073.

Moreover, techniques concerning the thermal transfer film provided with a coloring layer on a substrate film via an intermediate layer using the polycaprolactone resin have been known. For example, Japanese Patent Application Laid-Open (JP-A) No. 60-165291 discloses the use of a polycaprolactone resin in the intermediate layer for the purpose of printing for many times, and further, Japanese Patent Application Laid-Open (JP-A) No. 7-232483 discloses the use of a polycaprolactone having a 10,000 or less molecular weight in a primer layer for the purpose of high speed printing and smooth printing in a high temperature atmosphere.

However, according to the thermal transfer films using the intermediate layers of these techniques, the problem of blurring of the printed product due to lack of characters or fine lines caused by a generated void cannot be solved. Besides, since the molten state of the intermediate layer material continues for the time being after the thermal drying operation of the intermediate layer ink at the time of applying the ink to be the intermediate layer onto the substrate film, the base material surface and the intermediate layer surface of the thermal transfer film are bonded after being wound up after the application, and thus it is inconvenient. Furthermore, in the case of executing the hot melt coating method, which achieves the application at a low cost because it doesn't require a solvent in applying the coloring layer onto the substrate film provided with the intermediate layer, since the polycaprolactone in the intermediate layer is melted by the heat of the heated and melted coloring layer ink so as to be a liquid, the coloring layer ink cannot be applied stably with a good surface quality, and thus it is inconvenient.

SUMMARY OF THE INVENTION

Accordingly, in order to improve and solve the above-mentioned disadvantages and problems, an object of the present invention is to provide a thermal transfer film capable of providing a vivid print without generation of a void in a printed product, capable of applying preferably and stably the intermediate layer and the coloring layer to be formed on the substrate film, and further, having a classification leakage preventing function, and an image forming method using the same.

In order to achieve the object, the present inventor discussed elaborately, paying attention to the melt viscosity of the thermally fusible substances having the supercooling property such as a polycaprolactone resin in the molten state at the time the transfer receiving material and the thermal transfer film are peeled off so as to reach to the present invention concerning the thermal transfer film. Moreover, the coating suitability of the intermediate layer containing the thermally fusible substance having the supercooling property, such as a polycaprolactone, and the overcoating suitability of the coloring layer onto the intermediate layer were discussed in detail so that a group of binder resins capable of improving the suitability thereof without casting an adverse effect on the melt viscosity of the thermally fusible substance having the supercooling property such as a polycaprolactone resin were found out so as to reach to the present invention concerning the thermal transfer film. Furthermore, the time interval from heating and recording the superimposed thermal transfer film and transfer receiving material until separating them was measured for discussion so as to reach to the present invention concerning an image forming method capable of printing vividly without generation of a void in the printed product.

That is, a first aspect of a thermal transfer film according to the present invention comprises a coloring layer formed on a substrate film via an intermediate layer, wherein the intermediate layer contains a polycaprolactone resin having a 100 mPa·s or more and 1,000 mPa·s or less melt viscosity at 75° C., and a binder resin having a 130° C. or more and 400° C. or less extrapolation fuse starting temperature (the extrapolation fuse starting temperature defined in the JIS K7121-1987).

In a preferable embodiment of the first aspect, the thermal transfer film further has the following one or more features:

The binder resin is incompatible to the polycaprolactone resin;

The fuse peak temperature (the fuse peak temperature defined in the JIS K7121-1987) of the polycaprolactone resin is 45° C. or more and 70° C. or less, and the intermediate glass transitional temperature (the intermediate glass transitional temperature defined in the JIS K7121-1987) of the binder resin of the intermediate layer is higher than the fuse peak temperature of the polycaprolactone resin by 2° C. or more;

The number average molecular weight of the binder resin is 8,000 or more and 1,000,000 or less;

The binder resin is a polyester resin;

The intermediate layer contains a carbon black;

The intermediate layer comprises a porous film comprising formed the binder resin and not to be thermally transferred, with a thermally fusible substance contained in the pores of the porous film;

The porous film further comprises a carbon black;

The melt viscosity at 100° C. of the coloring layer is 150 mPa·s or more and 300 mPa·s or less; and/or, The difference between the fuse peak temperature (the fuse peak temperature defined in the JIS K7121-1987) of the coloring layer and the fuse peak temperature (the fuse peak temperature defined in the JIS K7121-1987) of the polycaprolactone resin is 10° C. or less.

An image forming method according to the first aspect of the present invention comprises the steps of superimposing a transfer receiving material onto the coloring layer surface of a thermal transfer film, heating and recording from the substrate film side like pixels by heating means, and separating the thermal transfer film and the transfer receiving material, wherein the thermal transfer film according to the first aspect of the present invention is used, and the time from recording the pixels to separating the thermal transfer film and the transfer receiving material is 0.05 second or more and 2 seconds or less.

In a preferable embodiment of the first aspect, the image forming method further has the following one or more features:

The heating means is an entire surface glaze type thermal head or a partial glaze type thermal head; and/or, The energy for heating and recording is 10 mJ/mm$^2$ or more and 35 mJ/mm$^2$ or less.

A second aspect of a thermal transfer film according to the present invention comprises a coloring layer formed on a substrate film via an intermediate layer, wherein the intermediate layer contains a thermally fusible substance having a 100 mPa·s or more and 1,000 mPa·s or less melt viscosity at 75° C., and a binder resin having a 150° C. or more and 400 ° C. or less extrapolation fuse starting temperature (the extrapolation fuse starting temperature defined in the JIS K7121-1987), the thermally fusible substance having a crystallization peak temperature (the crystallization peak temperature defined in the JIS K7121-1987) which is lower than the fuse peak temperature (the fuse peak temperature defined in the JIS K7121-1987) of the same thermally fusible substance by 10° C. to 50° C.

In a preferable embodiment of the second aspect, the thermal transfer film further has the following one or more features:

The binder resin is incompatible to the thermally fusible substance;

The intermediate glass transitional temperature (the intermediate glass transitional temperature defined in the JIS K7121-1987) of the binder resin is higher than the fuse peak temperature (the fuse peak temperature defined in the JIS K7121-1987) thermally fusible substance by 2° C. or more;

The number average molecular weight of the binder resin is 8,000 or more and 1,000,000 or less;

The binder resin is a polyester resin;

The intermediate layer contains a carbon black;

The intermediate layer comprises a porous film comprising the binder resin and not to be thermally transferred, with a thermally fusible substance contained in the pores of the porous film;

The porous film further comprises a carbon black;

The melt viscosity at 100° C. of the coloring layer is 150 mPa·s or more and 300 mPa·s or less; and/or, The difference between the fuse peak temperature (the fuse peak temperature defined in the JIS K7121-1987) of the coloring layer and the fuse peak temperature (the fuse peak temperature defined in the JIS K7121-1987) of the thermally fusible substance is 10° C. or less.

An image forming method according to the second aspect of the present invention comprises the steps of superimposing a transfer receiving material onto the coloring layer surface of a thermal transfer film, heating and recording from the substrate film side like pixels by heating means, and separating the thermal transfer film and the transfer receiving material, wherein the thermal transfer film according to the second aspect of the present invention is used, and the time from recording the pixels to separating the thermal transfer film and the transfer receiving material is 2 seconds or less.

In a preferable embodiment of the second aspect, the image forming method further has the following one or more features:

The heating means is an entire surface glaze type thermal head or a partial glaze type thermal head; and/or, The energy for heating and recording is 10 mJ/mm$^2$ or more and 35 mJ/mm$^2$ or less.

A third aspect of a thermal transfer film according to the present invention comprises a coloring layer formed on a substrate film via an intermediate layer, wherein the intermediate layer contains a polycaprolactone resin having a 100 mPa·s or more and 1,000 mPa·s or less melt viscosity at 75° C., and a non-transferable binder resin having a 130° C. or more and 400° C. or less softening temperature (the softening temperature measured by the ring and ball method defined in the JIS K2207-1980).

In a preferable embodiment of the third aspect, the thermal transfer film further has the following one or more features:

The binder resin is incompatible to the polycaprolactone resin;

The fuse peak temperature (the fuse peak temperature defined in the JIS K7121-1987) of the polycaprolactone resin is 45° C. or more and 70° C. or less, and the intermediate glass transitional temperature (the intermediate glass transitional temperature defined in the JIS K7121-1987) of the binder resin of the intermediate layer is higher than the fuse peak temperature of the polycaprolactone resin by 2° C. or more;

The number average molecular weight of the binder resin is 8,000 or more and 1,000,000 or less;

The binder resin is a resin having a benzene ring structure;

The binder resin is a polyester resin;

The intermediate layer contains a carbon black;

The intermediate layer comprises a porous film comprising the binder resin and not to be thermally transferred, with a polycaprolactone resin contained in the pores of the porous film;

The porous film further comprises a carbon black;

The melt viscosity at 100° C. of the coloring layer is 150 mPa·s or more and 300 mPa·s or less; and/or, The difference between the fuse peak temperature (the fuse peak temperature defined in the JIS K7121-1987) of the coloring layer and the fuse peak temperature (the fuse peak temperature defined in the JIS K7121-1987) of the polycaprolactone resin is 10° C. or less.

An image forming method according to the third aspect of the present invention comprises the steps of superimposing a transfer receiving material onto the coloring layer surface of a.thermal transfer film, heating and recording from the substrate film side like pixels by heating means, and separating the thermal transfer film and the transfer receiving material, wherein the thermal transfer film according to the third aspect of the present invention is used, and the time from recording the pixels to separating the thermal transfer film and the transfer receiving material is 0.05 second or more and 2 seconds or less.

In a preferable embodiment of the third aspect, the image forming method further has the following one or more features:

The heating means is an entire surface glaze type thermal head or a partial glaze type thermal head; and/or, The energy for heating and recording is 10 mJ/mm or more and 35 mJ/mm$^2$ or less.

A fourth aspect of a thermal transfer film according to the present invention comprises a coloring layer formed on a substrate film via an intermediate layer, wherein the intermediate layer contains a thermally fusible substance having a 100 mPa·s or more and 1,000 mPa·s or less melt viscosity at 75° C., and a non-transferable binder resin having a 130° C. or more and 400° C. or less softening temperature (the softening temperature measured by the ring and ball method defined in the JIS K2207-1980), the thermally fusible substance having a crystallization peak temperature (the crystallization peak temperature defined in the JIS K7121-1987) which is lower than the fuse peak temperature (the fuse peak temperature defined in the JIS K7121-1987) by 10° C. to 50° C.

In a preferable embodiment of the fourth aspect, the thermal transfer film further has the following one or more features:

The binder resin is incompatible to the thermally fusible substance;

The intermediate glass transitional temperature (the intermediate glass transitional temperature defined in the JIS K7121-1987) of the binder resin is higher than the fuse peak temperature (the fuse peak temperature defined in the JIS K7121-1987) of the thermally fusible substance by 2° C. or more.

The number average molecular weight of the binder resin is 8,000 or more and 1,000,000 or less;

The binder resin is a resin having a benzene ring structure;

The binder resin is a polyester resin;

The intermediate layer contains a carbon black;

The intermediate layer comprises a porous film comprising the binder resin and not to be thermally transferred, with a thermally fusible substance contained in the pores of the porous film;

The porous film further comprises a carbon black;

The melt viscosity at 100° C. of the coloring layer is 150 mPa·s or more and 300 mPa·s or less; and/or The difference between the fuse peak temperature (the fuse peak temperature defined in the JIS K7121-1987) of the coloring layer and the fuse peak temperature (the fuse peak temperature defined in the JIS K7121-1987) of the thermally fusible substance is 10° C. or less.

An image forming method according to the fourth aspect of the present invention comprises the steps of superimposing a transfer receiving material onto the coloring layer surface of a thermal transfer film, heating and recording from the substrate film side like pixels by heating means, and separating the thermal transfer film and the transfer receiving material, wherein the thermal transfer film according to the fourth aspect of the present invention is used, and the time from recording the pixels to separating the thermal transfer film and the transfer receiving material is 2 seconds or less.

In a preferable embodiment of the fourth aspect, the image forming method further has the following one or more features:

The heating means is an entire surface glaze type thermal head or a partial glaze type thermal head; and/or, The energy for heating and recording is 10 mJ/mm$^2$ or more and 35 mJ/mm$^2$ or less.

According to the present invention with the above-mentioned configuration, it was found out that since the intermediate layer comprising a specific binder resin and a polycaprolactone resin or a thermally fusible substance is in the state with the interface with respect to the coloring layer fused owing to the supercooling property of the components as well as in the low viscosity state even if the portion applied with the printing energy is cooled down to some extent in the interval from printing to the peel-off, the coloring layer can be peeled off from the thermal transfer film by a low peeling force so as to be transferred onto the transfer receiving material, and thus remaining of the coloring layer at the portion applied with the printing energy causing the cohesive failure within the layer, on the intermediate layer can be prevented so that the thermal transfer film can be peeled off, so that the interface between the coloring layer and the intermediate layer can be separated. Moreover, it was also found out that the coloring layer in the region applied with the energy can be transferred onto the transfer receiving material without a void, and thus a preferable printed product can be obtained with little void even with respect to a rough paper as the transfer receiving material.

DETAILED DESCRIPTION OF THE PREFERRED EMBODIMENTS

Figure 1:
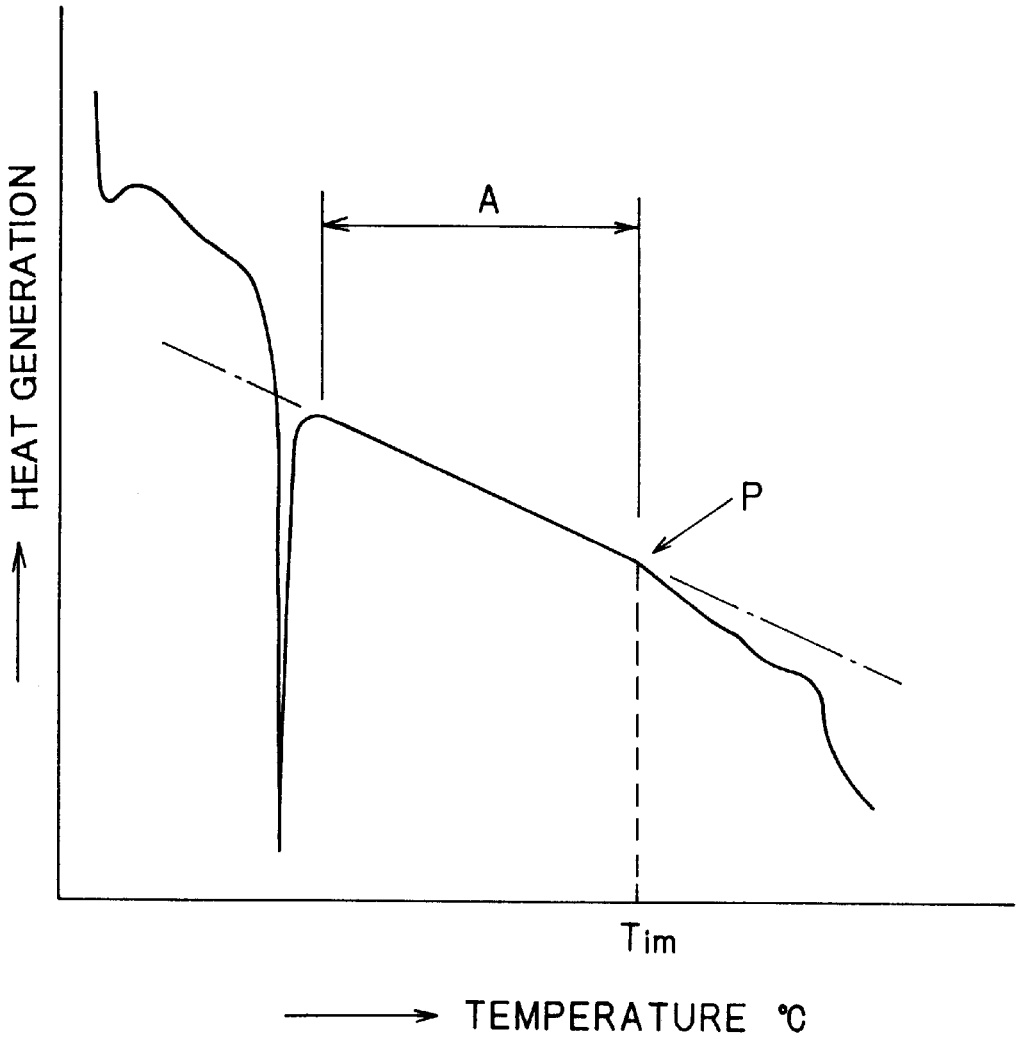
FIG. 1 is a graph for explaining a method for measuring an extrapolation fuse starting temperature of a binder resin in the present invention.

Hereinafter embodiments of the present invention will be described in detail.

First Embodiment of the Thermal Transfer Film

A thermal transfer film according to the present invention comprises a coloring layer formed on a substrate film via an intermediate layer, wherein the intermediate layer contains a polycaprolactone resin having a 100 mPa·s or more and 1,000 mPa·s or less melt viscosity at 75° C., and a binder resin having a 130° C. or more and 400° C. or less extrapolation fuse starting temperature.

(Substrate Film)

As a substrate film to be used in a thermal transfer film of the present invention, the substrate films used in the conventional thermal transfer films can be used as well as the other ones can be used, and it is not particularly limited.

Examples of preferable substrate films include plastics, such as polyester, polypropylene, cellophane, polycarbonate, cellulose acetate, polyethylene, polyvinyl chloride, polystyrene, nylon, polyimide, polyvinylidene chloride, polyvinyl alcohol, fluorine resin, chlorinated rubber, and ionomer; papers such as a condenser paper, and a paraffin paper; and non-woven fabrics. Further, composite substrate films with a combination of the above-mentioned materials can be used as well.

The thickness of the substrate film can be changed optionally according to the material such that appropriate strength and heat conductivity can be obtained. The thickness is preferably, for example, 3 to 10 $\mu$m.

(Intermediate Layer)

An intermediate layer contains a polycaprolactone resin having a 100 mPa·s or more and 1,000 mPa·s or less melt viscosity at 75° C., and a binder resin having a 130° C. or more and 400° C. or less extrapolation fuse starting temperature defined in the JIS K7121-1987.

The polycaprolactone resin used in the present invention is a resin having a repeated structure obtained by polymerization of $\epsilon$-caprolactone monomers (existing chemical substance No. 5-1091), such as polycaprolactone diol and polycaprolactone triol (existing chemical substance No. 7-808).

The melt viscosity can be measured in the present invention with the following measuring device.

Device name: Viscoelasticity measuring device Rotobisuco RV20 (Produced by HAKKE Corp.)

Measuring head part: M5

Sensor system: Sensor System Cone Plate PK5 (open angle 0.5°, cone plate radius 25 mm, set temperature 75° C.), or Sensor System MV type (MV1, set temperature 75° C.). However, the appropriate cone plate should optionally be selected depending on the viscosity region to be measured.

In an intermediate layer according to the present invention, wherein a polycaprolactone resin and a binder resin are contained, it is necessary to provide the intermediate layer without a substantial change in the fuse peak temperature of the polycaprolactone resin itself even when the polycaprolactone resin is mixed with the binder resin. Therefore, it is preferable to produce the state wherein the polycaprolactone resin is disposed in the pores of the porous film formed with the binder resin as a main material.

That is, the binder resin forms a mesh-like porous film without fusing in printing heating so as to remain on the substrate film side of the thermal transfer film without being thermally transferred to the transfer receiving material.

Moreover, the polycaprolactone resin is contained in the pores surrounded by the porous film so that the polycaprolactone resin is transferred to the transfer receiving material at the time of printing heating in the state with a low melt viscosity. Even if the intermediate layer is cooled to some extent from printing to peeling off, owing to the supercooling property of the polycaprolactone resin, the transfer receiving material and the thermal transfer film can be peeled off with the intermediate layer in the fused state. Accordingly, the domain of the coloring layer applied with the energy can be transferred to the transfer receiving material without generating a void so that a preferable printed product with little void can be obtained even with respect to a rough paper as the transfer receiving material.

Therefore, it is preferable that the intermediate layer contains a polycaprolactone resin having a low melt viscosity, and a binder resin having a 130° C. or more and 400° C. or less extrapolation fuse starting temperature defined in the JIS K7121-1987 as the main components as mentioned above, the binder resin and the polycaprolactone resin are incompatible, and the binder resin comprises a porous structure as a layer. In order to obtain the porous structure, it is effective that the polycaprolactone resin has a 100 mPa·s or more and 1,000 mPa·s or less melt viscosity at 75° C., and the binder resin has a 130° C. or more and 400° C. or less extrapolation fuse starting temperature (the extrapolation fuse starting temperature defined in the JIS K7121-1987).

Here, the incompatibility in the present invention will be explained. In the present invention, the state wherein the difference between the fuse peak temperature obtained by the measurement with only the polycaprolactone resin used in the intermediate layer, and the fuse peak temperature obtained by the measurement with the intermediate layer containing the polycaprolactone resin in the binder resin used in the intermediate layer, provided on a polyethylene terephthalate film is 5° C. or less is defined that the polycaprolactone and the binder resin are incompatible. The above-mentioned measurement of the fuse peak temperature is executed according to the JIS K7121-1987.

In the case the above-mentioned difference between the fuse peak temperatures is more than 5° C., the binder resin is considered to be dissolved partially or entirely with respect to the polycaprolactone resin in the molecular level. In this case, even if the polycaprolactone resin is fused, according to the existence of the binder resin component, flowability of the polycaprolactone resin is prevented so that the melt viscosity is increased. As a result, an inconvenience is generated in that a printed product with little void cannot be obtained with respect to a rough paper. Moreover, in the case the binder resin is dissolved sufficiently with respect to the polycaprolactone resin in the molecular level, the fuse peak temperature according to the fusion of the polycaprolactone resin cannot be observed. Also in this case, similar to the above-mentioned case, an inconvenience is generated in that a printed product with little void cannot be obtained with respect to a rough paper.

If the melt viscosity at 75° C. of the polycaprolactone resin used in the present invention is more than 1,000 mPa·s, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void. Moreover, even in the case the binder resin and the polycaprolactone resin are separated appropriately, if the melt viscosity at 75° C. of the polycaprolactone resin used is more than 1,000 mPa·s, the flowability of the polycaprolactone resin to be in the fused state(the liquid state) subject to the application of an energy by printing as is insufficient at the time of peeling off the transfer receiving material and the thermal transfer film, and thus it is difficult to transfer the coloring layer onto the receiving paper without generating a void.

If the melt viscosity at 75° C. of the polycaprolactone resin used in the present invention is less than 100 mPa·s, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void. Moreover, even in the case the binder resin and the polycaprolactone resin are separated appropriately, if the melt viscosity at 75° C. of the polycaprolactone resin used is less than 100 mPa·s, it is difficult to overcoat the coloring layer stably with a good surface quality at the time of applying the coloring layer on the substrate film provided with the intermediate layer by the hot melt coating method.

The porous film in the present invention can be a film with either a porous structure observable by naked eyes, an optical microscope, a scanning electron microscope, a transmission electron microscope or a confocal laser microscope, or an extremely fine porous structure not observable with these equipments.

As a binder resin of the intermediate layer, any resin can be used as long as it has a 130° C. or more and 400° C. or less extrapolation fuse starting temperature defined in the JIS K7121-1987, and is capable of maintaining the film forming property without having a low viscosity at the time of coating the coloring layer on the intermediate layer formed on the substrate film and at the time of the printing heating. In particular, a resin incompatible with a polycaprolactone resin is preferable. Examples thereof include: polyester resins; polybutadiene resins such as SBR resins, ABS resins and SBS resins; maleic acid resins such as styrene-maleic anhydride copolymers; olefin resins; olef in copolymers; ionomer resins; and styrene resins. Among these examples, the polyester resins are preferable.

Measurement of the extrapolation fuse starting temperature (the extrapolation fuse starting temperature defined in the JISK7121-1987) of the binder resin in the present invention will be explained. In the present invention, the temperature at the intersection of the straight line extending the base line at the low temperature side to the high temperature side and the tangent on the maximum gradient point of the curve at the low temperature side with respect to the fuse peak in the DSC curve obtained by the measurement according to the JIS K7121-1987 (the differential scanning calorimeter DSC method) is defined to be the extrapolation fuse starting temperature (Tim). Moreover, some of the binder resins are amorphous resins, whose DSC curve has a peak derived from the glass transition but without a clear fuse peak as shown in FIG. 1. In the present invention, the extrapolation fuse starting temperature of such an amorphous binder resin is measured as follows. That is, the straight line portion existing at the high temperature side with respect to the peak derived from the glass transition of the DSC curve (the range shown by the arrow A in FIG. 1) is regarded as the base line, and the temperature at a point P at which the DSC curve for the first time leaves the straight line obtained by extending the base line to the high temperature side is defined to be the extrapolation fuse starting temperature (Tim).

In the case the extrapolation fuse starting temperature (the extrapolation fuse starting temperature defined in the JIS K7121-1987) of the binder resin is lower than 130° C., it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void.

Furthermore, since a binder resin having an extrapolation fuse starting temperature (the extrapolation fuse starting temperature defined in the JIS K7121-1987) more than 400° C. is an expensive material in most cases for having an excessive heat resistance, the production cost of the thermal transfer film can be too high, and thus it is inconvenient.

In the present invention, it is preferable that the fuse peak temperature defined in the JIS K7121-1987 of the above-mentioned polycaprolactone resin is 45° C. or more and 70° C. or less, and the intermediate glass transitional temperature defined in the JIS K7121-1987 of the binder resin of the intermediate layer is higher than the fuse peak temperature (the fuse peak temperature defined in the JIS K7121-1987) of the polycaprolactone resin by 2° C. or more.

Furthermore, it is preferable that the number average molecular weight of the binder resin of the intermediate layer is 8,000 or more and 1,000,000 or less.

In the case the fuse peak temperature defined in the JIS K7121-1987 of the polycaprolactone resin is more than 70° C., the sensitivity is insufficient. In contrast, in the case it is less than 45° C., the substrate surface and the intermediate layer surface of the thermal transfer film wound up after applying the ink onto the substrate film for providing the intermediate layer are bonded, and thus it is inconvenient.

In the case the intermediate glass transitional temperature of the binder resin of the intermediate layer is not higher than the fuse peak temperature of the polycaprolactone resin by 2° C. or more, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void.

As mentioned above, it is preferable that the intermediate glass transitional temperature of the binder resin of the intermediate layer is higher than the fuse peak temperature of the polycaprolactone resin by 2° C. or more, but the upper limit of the temperature difference thereof is not particularly limited. However, if the temperature difference is more than 100° C., the binder resin is an expensive material in most cases for having an excessive heat resistance so that the production cost of the thermal transfer film can be too high, and thus it is inconvenient.

In the case the number average molecular weight of the binder resin of the intermediate layer is less than 8,000, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void. Moreover, also in the case the number average molecular weight of the binder resin of the intermediate layer is more than 1,000,000, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void.

Furthermore, by including a carbon black in the intermediate layer, it is difficult to read out the content of the print from the thermal transfer film after printing (to read out the content of the print by the transfer film from a copy obtained by copying the residue of the coloring layer of the thermal transfer film after transfer by a copying machine or the like) so that the classification leakage preventing function can be provided.

In the case a carbon black is included in the intermediate layer, it is preferable that the melt viscosity at 75° C. of the polycaprolactone resin with the carbon black added is also 100 mPa·s or more and 1,000 mPa·s or less. Moreover, in the case of a thermal transfer film, wherein the binder resin contained in the intermediate layer forms a porous film not to be thermally transferred, with a polycaprolactone resin contained in the pores, in order to prevent deterioration of the flowability of the thermally fusible substance at the time of fusion due to the added carbon black, it is preferable to provide mainly the carbon black in the porous film structure not to be thermally transferred comprising the binder resin contained in the intermediate layer. That is, it is preferable not to provide the carbon black mainly in the polycaprolactone resin provided in the pores.

In order to provide the carbon black mainly in the porous film structure not to be thermally transferred comprising the binder resin provided in the intermediate layer, it is preferable to disperse the carbon black in the binder resin in the sufficiently stable state by an ordinary method, and mix the solution of th e polycaprolactone resin therein. The sufficiently stable state herein denotes the state not to substantially generate the sediment of the carbon black after leaving the dispersion with the carbon black dispersed in the binder resin still for 100 days at an ordinary temperature. For dispersing the carbon black, devices such as a sand mill and a bead mill can be used.

The intermediate layer can be formed by mixing the above-mentioned materials with a dispersing agent such as a higher aliphatic alcohol, an ester phosphate and a metal salt thereof, an organic carboxylic acid and a derivative thereof, a low melting point wax, various kinds of surfactant, or the like, as needed, dissolving or dispersing the same in an appropriate solvent, such as methylethyl ketone, toluene, alcohols, water, or the like so as to prepare a coating liquid, coating the same by commonly used coating means, such as a gravure coater, a roll coater, and a wire bar, and drying.

The coating amount of the intermediate layer is preferably about 0.1 to 1.0 g/m$^2$, for the dry solid component. If the coating amount is less than 0.1 g/m$^2$, a vivid printed product without generation of a void can hardly be obtained. In contrast, if the coating amount is more than 1.0 g/m$^2$, the intermediate layer is so thick that the printing sensitivity at the time of transfer is deteriorated, and thus it is not preferable.

(Coloring Layer)

In the present invention, a coloring layer is provided on the above-mentioned intermediate layer. The coloring layer is a thermally fusible ink layer, which may comprise a conventionally known coloring agent and binder, optionally added with an ore oil, a plant oil, a higher aliphatic acid such as a stearic acid, and various kinds of additives such as a plasticizer, an antioxidant, and a filler.

As a wax component to be used as a binder, for example, microcrystalline wax, carnauba wax, paraffin wax, or the like, can be presented. Furthermore, various kinds of waxes, such as Fischer-Tropsch wax, various kinds of low molecular weight polyethylenes, wood wax, bee wax, whale wax, insect wax, wool wax, shellac wax, candelilla wax, petrolatum, polyester wax, partially denatured wax, aliphatic acid ester, and aliphatic acid amide can be used. Among these examples, those having a 50 to 85° C. melting point are particularly preferable. If it is less than 50° C., a problem is involved in the storage property, but if it is more than 85° C., the sensitivity is insufficient.

As a resin component to be used as a binder, for example, ethylene-vinyl acetate copolymers, ethylene-acrylate copolymers, polyethylenes, polystyrenes, polypropylenes, polybutenes, oil resins, vinyl chloride resins, vinyl chloride-vinyl acetate copolymers, polyvinyl alcohols, vinylidene chloride resins, methacrylic resins, polyamides, polycarbonates, fluorine resins, polyvinyl formal, polyvinyl butylal, acetyl cellulose, nitro cellulose, polyvinyl acetate, polyisobutylene, ethyl cellulose, and polyacetal can be presented. In particular, those conventionally used as a heat sensitive adhesive having a relatively low softening point (e.x., at 50 to 80° C.) are preferable.

The coloring agent can be selected among conventionally known organic or inorganic pigments or dyes. For example, one having a sufficient coloring density without the risk of discoloration or fading with respect to light or heat is preferable. Moreover, it can be a substance to be colored by heating or a substance to be colored by contact with a component applied on the surface of the transfer receiving material. Furthermore, the color of the coloring agent is not limited to cyan, magenta, yellow, and black, but coloring agents of various colors can be used.

Moreover, a thermally conductive substance can be added as a filler of the binder for providing good heat conductivity and thermally fusible property to the coloring layer. Examples of the filler include carbon substances such as a carbon black, metals or metal compounds such as aluminum, copper, tin oxide, and molybdenum disulfide.

The coloring layer can be formed by mixing the above-mentioned coloring agent components, the binder components with an ore oil, a plant oil, a higher aliphatic acid such as stearic acid, and various kinds of additives such as a plasticizer, an antioxidant, and a filler, as needed, adding an appropriate solvent component, such as water and an organic solvent thereto so as to prepare a coloring layer forming coating liquid, and coating the same by commonly used methods, such as hot melt coating, hot lacquer coating, gravure coating, gravure reverse coating, and roll coating. Moreover, a formation method using an aqueous or non-aqueous emulsion coating liquid can also be used.

The thickness of the coloring layer should be determined in balance with the necessary printing density and the heat sensitivity. It is preferably in the range of 0.5 to 6.5 g/m$^2$, and particularly preferably in the range of 2.5 to 4.5 g/m$^2$.

Since the thermal transfer film according to the present invention has the intermediate layer with the above-mentioned configuration, a printed product with little void can be obtained on a rough paper. With a 150 mPa·s or more and 300 mPa·s or less melt viscosity at 100° C. of the coloring layer, a printed product with further less void can be obtained with respect to a rough paper. In the case the melt viscosity of the coloring layer at 100° C. is less than 150 mPa·s, the further effect of the void prevention with respect to the rough paper cannot be obtained. In contrast, if the melt viscosity is more than 300 mPa·s, the coating suitability at the time of applying and forming the coloring layer by the hot melt coating method is deteriorated so that coating with a good surface state can be difficult.

Moreover, in the thermal transfer film according to the present invention, by setting the difference between the fuse peak temperature (the fuse peak temperature defined in the JIS K7121-1987) of the coloring layer and the fuse peak temperature (the fuse peak temperature defined in the JIS K7121-1987) of the polycaprolactone resin at 10° C. or less, a printed product with further little void can be obtained with respect to a rough paper as well as the phenomenon of the coloring layer adhesion like a thin film without sticking onto the surface of the transfer receiving material (entangle phenomenon) can be reduced. For example, in the case the fuse peak temperature of the polycaprolactone resin is 60° C., by having the fuse peak temperature of the coloring layer at 50° C. or more and 70° C. or less, the above-mentioned effect can be obtained. The more effect can be achieved with a smaller temperature difference within 10° C. With the 0° C. temperature difference, the most preferable printing result can be obtained. In contrast, if the temperature difference is more than 10° C., the entangle phenomenon prevention effect cannot be obtained sufficiently.

(Heat Resistant Slipping Layer)

Moreover, in order to prevent sticking of a thermal head and to improve the sliding property, a heat resistant slipping layer can be provided on the other surface of the substrate film.

The heat resistant slipping layer is formed preferably, using a material prepared by adding a sliding agent, a surfactant, an inorganic particle, an organic particle, a pigment or the like, to a binder resin.

As the binder resin used in the heat resistant slipping layer, for example, cellulose resins such as ethyl cellulose, hydroxyethyl cellulose, hydroxypropyl cellulose, methyl cellulose, cellulose acetate, cellulose acetate butyrate, and nitrocellulose; vinyl resins such as polyvinyl alcohol, polyvinyl acetate, polyvinyl butylal, polyvinyl acetal, polyvinyl pyrrolidone, acrylic resins, polyacrylic amide, and acrylonitrile-styrene copolymers; polyester resins; polyurethane resins; and silicone denatured or fluorine denatured urethane resins can be presented.

It is preferable to use those having several reactive groups such as hydroxyl groups among these examples, and use a polyisocyanate as a cross-liking agent so as to provide a cross-linked resin.

Means for forming the heat resistant slipping layer comprises the steps of, as mentioned above, using a material prepared by adding a sliding agent, a surfactant, an inorganic particle, an organic particle, a pigment or the like, to a binder resin, dissolving or dispersing the same in an appropriate solvent so as to prepare a coating liquid, coating the same by commonly used coating means, such as a gravure coater, a roll coater, and a wire bar, and drying.

Second Embodiment of the Thermal Transfer Film

A thermal transfer film according to the present invention comprises a coloring layer formed on a substrate film via an intermediate layer, wherein the intermediate layer contains a thermally fusible substance having a 100 mPa·s or more and 1,000 mPa·s or less melt viscosity at 75° C., and a binder resin having a 150° C. or more and 400° C. or less extrapolation fuse starting temperature. The crystallization peak temperature defined in the JIS K7121-1987 of the above-mentioned thermally fusible substance is lower than the fuse peak temperature defined in the JIS K7121-1987 of the same thermally fusible substance by 10° C. to 50° C.

(Substrate Film)

As a substrate film to be used in a thermal transfer film of the present invention, the substrate films used in the conventional thermal transfer films can be used as well as the other ones can be used, and it is not particularly limited.

As concrete examples of preferable substrate films, those mentioned in the above-mentioned first embodiment can be presented. The thickness thereof is preferably, for example, 3 to 10 $\mu$m.

(Intermediate Layer)

An intermediate layer contains a thermally fusible substance having a 100 mPa·s or more and 1,000 mPa·s or less melt viscosity at 75° C., and a binder resin having a 150° C. or more and 400° C. or less extrapolation fuse starting temperature defined in the JIS K7121-1987 as well as the thermally fusible substance has a crystallization peak temperature defined in the JIS K7121-1987 lower than the fuse peak temperature defined in the JIS K7121-1987 by 10° C. to 50° C.

Examples of the thermally fusible substance used in the intermediate layer according to the present invention include polyethylene glycol and derivatives thereof, polycaprolactone resins, and polyurethane waxes. However, any one can be used as long as it has a 100 mPa·s or more and 1,000 mPa·s or less melt viscosity at 75° C., and the supercooling property with a temperature difference between the crystallization peak temperature defined in the JIS K7121-1987 and the fuse peak temperature defined in the JIS K7121-1987 in the range of 10° C. to 50° C.

The melt viscosity can be measured in the present invention with the device mentioned in the above-mentioned first embodiment in the same manner.

As the above-mentioned polyethylene glycol, a polyethylene glycol derivative having about 3,000 to 5,000 molecular weight can be used preferably.

The polycaprolactone resin is a resin having a repeated structure obtained by polymerization of $\epsilon$-caprolactone monomers (existing chemical substance No. 5-1091), such as polycaprolactone diol and polycaprolactone triol (existing chemical substance No. 7-808).

The hydroxyl group at the end of the above-mentioned polyethylene glycol can be substituted by various groups. Moreover, a polyester substance, a silicone substance, a polyamide substance or the like can also be used preferably as long as it has the above-mentioned physical properties.

The thermally fusible substance has a crystallization peak temperature (the crystallization peak temperature defined in the JIS K7121-1987) lower than the fuse peak temperature (the fuse peak temperature defined in the JIS K7121-1987) of the same thermally fusible substance by 10° C. to 50° C.

If the above-mentioned temperature difference between the crystallization peak temperature and the fuse peak temperature is less than 10° C., the supercooling property of the thermally fusible substance is weakened so that the low viscosity thermally fusible substance fused after the printing heating is crystallized and aggregated, or the low viscosity thermally fusible substance fused after the printing heating has the viscosity rise according to the temperature drop, and thus a void is generated in the printed product and a vivid print cannot be obtained. In contrast, if the temperature difference between the crystallization peak temperature and the fuse peak temperature is more than 50° C., since the state with the thermally fusible substance fused by the heat continues excessively after heat drying of the intermediate layer in applying the ink for providing the intermediate layer on the substrate film, the substrate film surface (the opposite side with respect to the intermediate layer formation side) and the intermediate layer surface of the thermal transfer film wound up after the application are bonded, and thus it is inconvenient.

As to the concrete numerical values of the crystallization and the fuse peak temperature, for example, about 45° C. to 70° C. fuse peak temperature defined in the JIS K7121-1987 of the thermally fusible substance can be presented. If the fuse peak temperature is too high, the sensitivity is insufficient. In contrast, the fuse peak temperature is too low, the inconvenience of bonding of the substrate film surface and the intermediate layer surface of the thermal transfer film wound up after applying the ink for providing the intermediate layer onto the substrate film can easily be generated.

In an intermediate layer according to the present invention, wherein a thermally fusible substance and a binder resin are contained, it is necessary to provide the intermediate layer without a substantial change in the crystallization peak temperature and the fuse peak temperature of the thermally fusible substance itself even when the thermally fusible substance is mixed with the binder resin. Therefore, it is preferable to produce the state wherein the thermally fusible substance is disposed in the pores of the porous film formed with the binder resin, as a main material.

That is, the binder resin forms a mesh-like porous film without fusing in printing heating so as to remain on the substrate film side of the thermal transfer film without being thermally transferred to the transfer receiving material.

Moreover, the thermally fusible substance is contained in the pores surrounded by the porous film so that the thermally fusible substance is transferred to the transfer receiving material at the time of printing heating in the state with a low melt viscosity. Even if the intermediate layer is cooled to some extent from printing to peeling off, owing to the supercooling property of the thermally fusible substance, the transfer receiving material and the thermal transfer film can be peeled off with the intermediate layer in the fused state. Accordingly, the domain of the coloring layer applied with the energy can be transferred to the transfer receiving material without generating a void so that a preferable printed product with little void can be obtained even with respect to a rough paper as the transfer receiving material.

Therefore, it is preferable that the intermediate layer contains a thermally fusible substance having a low melt viscosity, and a binder resin having a 150° C. or more and 400° C. or less extrapolation fuse starting temperature defined in the JIS K7121-1987 as the main components as mentioned above, the binder resin and the thermally fusible substance are incompatible, and the binder resin forms a porous structure as a layer. In order to obtain the porous structure, it is effective that the thermally fusible substance has a 1,000 mPa·s or less melt viscosity at 75° C., and the binder resin has a 150° C. or more extrapolation fuse starting temperature (the extrapolation fuse starting temperature defined in the JIS K7121-1987).

The above-mentioned incompatibility of the thermally fusible substance and the binder resin is the same as the incompatibility of the polycaprolactone resin and the binder resin explained in the first embodiment.

If the melt viscosity at 75° C. of the thermally fusible substance used in the present invention is more than 1,000 mPa·s, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void. Moreover, even in the case the binder resin and the thermally fusible substance are separated appropriately, if the melt viscosity at 75° C. of the thermally fusible substance is more than 1,000 mPa·s, the flowability of the thermally fusible substance to be in the fused state (a liquid state) subject to the application of an energy by printing as is insufficient at the time of peeling off the transfer receiving material and the thermal transfer film, and thus it is difficult to transfer the coloring layer onto the transfer receiving material without generating a void.

If the melt viscosity at 75° C. of the thermally fusible substance is less than 100 mPa·s, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void. Moreover, even in the case the binder resin and the thermally fusible substance are separated appropriately, it is difficult to overcoat the coloring layer stably with a good surface quality at the time of applying the coloring layer on the substrate film provided with the intermediate layer by the hot melt coating method.

The porous film in the present invention can be a film with either a porous structure observable by naked eyes, an optical microscope, a scanning electron microscope, a transmission electron microscope or a confocal laser microscope, or an extremely fine porous structure not observable with these equipments.

As a binder resin of the intermediate layer, any resin can be used as long as it has a 150° C. or more and 400° C. or less extrapolation fuse starting temperature defined in the JIS K7121-1987, and is capable of maintaining the film forming property without having a low viscosity at the time of coating the coloring layer on the intermediate layer formed on the substrate film and at the time of the printing heating. In particular, a resin incompatible with a polycaprolactone resin is preferable. Examples thereof include: polyester resins; polybutadiene resins such as SBR resins, ABS resins, and SBS resins; maleic acid resins such as styrene-maleic anhydride copolymers; olefin resins; olefin copolymers; ionomer resins; and styrene resins.

Measurement of the extrapolation fuse starting temperature (the extrapolation fuse starting temperature defined in the JISK7121-1987) of the binder resin in the present invention is the same as in the above-mentioned first embodiment.

In the case the extrapolation fuse starting temperature (the extrapolation fuse starting temperature defined in the JIS K7121-1987) of the binder resin is lower than 150° C., it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void.

Furthermore, since a binder resin having an extrapolation fuse starting temperature (the extrapolation fuse starting temperature defined in the JIS K7121-1987) more than 400° C. is an expensive material in most cases for having an excessive heat resistance, the production cost of the thermal transfer film can be too high, and thus it is inconvenient.

Japanese Patent Application Laid-Open (JP-A) No. 63-302090 discloses a technique of providing a thermally fusible substance such as a wax having a 40° C. to 150° C. melting point in an intermediate layer containing a polyoxiethylene derivative. However, the extrapolation fuse starting temperature defined in the JIS K7121-1987 of the thermally fusible substance used in the JP-A No. 63-302090 is less than 150° C., and thus even if it is used as the binder resin, the effect of the present invention cannot be obtained.

In the present invention, it is preferable that the intermediate glass transitional temperature defined in the JIS K7121-1987 of the binder resin of the above-mentioned intermediate layer is higher than the fuse peak temperature (the fuse peak temperature defined in the JIS K7121-1987) of the thermally fusible substance by 2° C. or more, but the upper limit of the temperature difference thereof is not particularly limited. However, if the temperature difference is more than 100° C., the binder resin is an expensive material in most cases for having an excessive heat resistance so that the production cost of the thermal transfer film can be too high, and thus it is inconvenient.

In the case the intermediate glass transitional temperature of the binder resin of the intermediate layer is not higher than the fuse peak temperature of the thermally fusible substance by 2° C. or more, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void.

Furthermore, the number average molecular weight of the binder resin of the intermediate layer is preferably 8,000 or more and 1,000,000 or less, and is particularly preferably 8,000 or more and 100,000 or less.

In the case the number average molecular weight of the binder resin of the intermediate layer is less than 8,000, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void. Moreover, also in the case the number average molecular weight of the binder resin of the intermediate layer is more than 1,000,000, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void.

Furthermore, by including a carbon black in the intermediate layer, it is difficult to read out the content of the print from the thermal transfer film after printing (to read out the content of the print by the transfer film from a copy obtained by copying the residue of the coloring layer of the thermal transfer film after transfer by a copying machine or the like) so that the classification leakage preventing function can be provided.

In the case a carbon black is included in the intermediate layer, it is preferable that the melt viscosity at 75° C. of the thermally fusible substance with the carbon black added is also 100 mPa·s or more and 1,000 mPa·s or less. Moreover, in the case of a thermal transfer film, wherein the binder resin contained in the intermediate layer comprises a porous film not to be thermally transferred, with a thermally fusible substance contained in the pores, in order to prevent deterioration of the flowability of the thermally fusible substance at the time of fusion due to the added carbon black, it is preferable to provide mainly the carbon black in the porous film structure not to be thermally transferred comprising the binder resin contained in the intermediate layer. That is, it is preferable not to provide the carbon black mainly in the thermally fusible substance provided in the pores.

In order to provide the carbon black mainly in the porous film structure not to be thermally transferred comprising the binder resin provided in the intermediate layer, it is preferable to disperse the carbon black in the binder resin in the sufficiently stable state by an ordinary method, and mix the solution of the thermally fusible substance therein. The sufficiently stable state herein denotes the state not to substantially generate the sediment of the carbon black after leaving the dispersion with the carbon black dispersed in the binder resin still for 100 days at an ordinary temperature. For dispersing the carbon black, devices such as a sand mill and a bead mill can be used.

In the case of using a water soluble substance such as a polyethylene glycol as the thermally fusible substance, it is preferable to use a dispersion prepared by dispersing, in the water, a water insoluble resin with less than 1 g solubility with respect to 100 g of water as the binder resin. Moreover, in the case of containing a carbon black in the intermediate layer using such a water-base binder resin liquid and the polyethylene glycol, it is preferable to disperse the carbon black preliminarily in the water insoluble resin before dispersing the water insoluble resin in water.

The intermediate layer can be formed by mixing the above-mentioned materials with a dispersing agent such as a higher aliphatic alcohol, an ester phosphate and a metal salt thereof, an organic carboxylic acid and a derivative thereof a low melting point wax, various kinds of surfactant, or the like, as needed, dissolving or dispersing the same in an appropriate solvent, such as methylethyl ketone, toluene, alcohols, water, or the like so as to prepare a coating liquid, coating the same by commonly used coating means, such as a gravure coater, a roll coater, and a wire bar, and drying.

The coating amount of the intermediate layer is preferably about 0.1 to 1.0 g/m$^2$ for the dry solid component. If the coating amount is less than 0.1 g/m$^2$, a vivid printed product without generation of a void can hardly be obtained. In contrast, if the coating amount is more than 1.0 g/m$^2$, the intermediate layer is so thick that the printing sensitivity at the time of transfer is deteriorated, and thus it is not preferable.

(Coloring Layer)

In the present invention, a coloring layer is provided on the above-mentioned intermediate layer. The coloring layer is a thermally fusible ink layer, which may comprise a conventionally known coloring agent and binder, optionally added with an ore oil, a plant oil, a higher aliphatic acid such as stearic acid, and various kinds of additives such as a plasticizer, an antioxidant and a filler.

The binder, the coloring agent, or the like to be used are the same as in the above-mentioned first embodiment. Further, formation of the coloring agent is the same as in the above-mentioned first embodiment.

The thickness of the coloring layer should be determined in balance with the necessary printing density and the heat sensitivity. It is preferably in the range of 0.5 to 8 g/m$^2$, and particularly preferably in the range of 2.5 to 6 g/m$^2$.

Furthermore, with a 150 mPa·s or more and 300 mPa·s or less melt viscosity at 100° C. of the coloring layer, a printed product with further less void can be obtained with respect to a rough paper as in the above-mentioned first embodiment. Moreover, as in the above-mentioned first embodiment, by setting the difference between the fuse peak temperature (the fuse peak temperature defined in the JIS K7121-1987) of the coloring layer and the fuse peak temperature (the fuse peak temperature defined in the JIS K7121-1987) of the thermally fusible substance at 10° C. or less, a printed product with further little void can be obtained with respect to a rough paper as well as the phenomenon of the coloring layer adhesion like a thin film without sticking onto the surface of the transfer receiving material (entangle phenomenon) can be reduced.

(Heat Resistant Slipping Layer)

Moreover, in order to prevent sticking of a thermal head and to improve the sliding property, a heat resistant slipping layer can be provided on the other surface of the substrate film.

The heat resistant slipping layer can be provided in the same manner as the heat resistant slipping layer described in the above-mentioned first embodiment.

Third Embodiment of the Thermal Transfer Film

A thermal transfer film according to the present invention comprises a coloring layer formed on a substrate film via an intermediate layer, wherein the intermediate layer contains a polycaprolactone resin having a 100 mPa·s or more and 1,000 mPa·s or less melt viscosity at 75° C., and a non-transferable binder resin having a 130° C. or more and 400° C. or less softening temperature (the softening temperature measured by the ring and ball method defined in the JIS K2207-1980).

(Substrate Film)

As a substrate film to be used in a thermal transfer film of the present invention, the substrate films used in the conventional thermal transfer films can be used as well as the other ones can be used, and it is not particularly limited.

As concrete examples of preferable substrate films, those mentioned in the above-mentioned first embodiment can be presented. The thickness thereof is preferably, for example, 3 to 10 $\mu$m.

(Intermediate Layer)

An intermediate layer contains a polycaprolactone resin having a 100 mPa·s or more and 1,000 mPa·s or less melt viscosity at 75° C., and a non-transferable binder resin having a 130° C. or more and 400° C. or less softening temperature (the softening temperature measured by the ring and ball method defined in the JIS K2207-1980).

The polycaprolactone resin used in the present invention is a resin having a repeated structure obtained by polymerization of e-caprolactone monomers (existing chemical substance No. 5-1091), such as polycaprolactone diol and polycaprolactone triol (existing chemical substance No. 7-808).

The melt viscosity can be measured in the present invention by the measurement method explained in the above-mentioned first embodiment in the same manner.

In the intermediate layer provided on the thermal transfer film according to the present invention, it is important that the binder resin is not fused at the time of printing heating so as to remain on the substrate film side of the thermal transfer film without being thermally transferred to the transfer receiving material.

Therefore, it is preferable that the binder resin and the polycaprolactone resin are incompatible. That is, in an intermediate layer according to the present invention, wherein a polycaprolactone resin and a binder resin are contained, it is important to provide the intermediate layer without a substantial change in the fuse peak temperature of the polycaprolactone resin itself even when the polycaprolactone resin is mixed with the binder resin. Therefore, it is preferable to produce the state wherein the polycaprolactone resin is disposed in the pores of the porous film formed with the binder resin as a main material.

The above-mentioned incompatibility of the polycaprolactone resin and the binder resin is the same as the incompatibility of the polycaprolactone resin and the binder resin explained in the first embodiment.

In the present invention, as mentioned above, it is preferable that the intermediate layer comprises a porous structure. Since the binder resin forms a mesh-like porous film, it is not fused in printing heating so as to remain on the substrate film side of the thermal transfer film without being thermally transferred to the transfer receiving material.

Moreover, the polycaprolactone resin is contained in the pores surrounded by the porous film so that the polycaprolactone resin is transferred to the transfer receiving material at the time of printing heating in the state with a low melt viscosity. Even if the intermediate layer is cooled to some extent from printing to peeling off, owing to the supercooling property of the polycaprolactone resin, the transfer receiving material and the thermal transfer film can be peeled off with the intermediate layer in the fused state. Accordingly, the domain of the coloring layer applied with the energy can be transferred to the transfer receiving material without generating a void so that a preferable printed product with little void can be obtained even with respect to a rough paper as the transfer receiving material.

Therefore, as mentioned above, it is preferable that the intermediate layer contains a polycaprolactone resin having a 100 mPa·s or more and 1,000 mPa·s or less melt viscosity at 75° C., and a binder resin having a 130° C. or more and 400° C. or less softening temperature measured by the ring and ball method defined in the JIS K2207-1980 as the main components as mentioned above, the binder resin and the polycaprolactone resin are incompatible, and the binder resin forms a porous structure as a layer.

If the melt viscosity at 75° C. of the polycaprolactone resin used in the present invention is more than 1,000 mPa·s, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void. Moreover, even in the case the binder resin and the polycaprolactone resin are separated appropriately, if the melt viscosity at 75° C. of the polycaprolactone resin is more than 1,000 mPa·s, the flowability of the polycaprolactone resin to be in the fused state (a liquid state) subject to the application of an energy by printing is insufficient at the time of peeling off the transfer receiving material and the thermal transfer film, and thus it is difficult to transfer the coloring layer onto the transfer receiving material without generating a void.

If the melt viscosity at 75° C. of the polycaprolactone resin is less than 100 mPa·s, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void. Moreover, even in the case the binder resin and the polycaprolactone resin are separated appropriately, it is difficult to overcoat the coloring layer stably with a good surface quality at the time of applying the coloring layer on the substrate film provided with the intermediate layer by the hot melt coating method.

The porous film in the present invention can be a film with either a porous structure observable by naked eyes, an optical microscope, a scanning electron microscope, a transmission electron microscope or a confocal laser microscope, or an extremely fine porous structure not observable with these equipments.

As a non-transferable binder resin having a 130° C. or more and 400° C. or less softening temperature (the softening temperature measured by the ring and ball method defined in the JIS K2207-1980), any resin can be used as long as it is non-transferable and is capable of maintaining the film forming property without having a low viscosity at the time of coating the coloring layer on the intermediate layer formed on the substrate film and at the time of the printing heating. In particular, a resin incompatible with a polycaprolactone resin is preferable. Examples thereof include: polyester resins; polybutadiene resins such as SBR resins, ABS resins and SBS resins; maleic acid resins such as styrene-maleic anhydride copolymers; olefin resins; olefin copolymers; ionomer resins; and styrene resins, and among of them polyester resin is particularly preferable.

In the case the softening temperature (the softening temperature measured by the ring and ball method defined in the JIS K2207-1980) of the binder resin is lower than 130° C., it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void.

Furthermore, since a binder resin having an softening temperature (the softening temperature measured by the ring and ball method defined in the JIS K2207-1980) more than 400° C. is an expensive material in most cases for having an excessive heat resistance, the production cost of the thermal transfer film can be too high, and thus it is inconvenient.

In the present invention, it is preferable that the fuse peak temperature defined in the JIS K7121-1987 of the polycaprolactone resin is 45° C. or more and 70° C. or less, and the intermediate glass transitional temperature defined in the JIS K7121-1987 of the binder resin of the intermediate layer is higher than the fuse peak temperature (the fuse peak temperature defined in the JIS K7121-1987) of the polycaprolactone resin by 2° C. or more.

Furthermore, the number average molecular weight of the binder resin of the intermediate layer is preferably 8,000 or more and 1,000,000 or less.

In the case the fuse peak temperature defined in the JIS K7121-1987 of the polycaprolactone resin is more than 70° C., the sensitivity is insufficient. In contrast, in the case it is less than 45° C., the substrate film surface and the intermediate layer surface of the thermal transfer film wound up after applying the ink onto the substrate film for providing the intermediate layer are bonded, and thus it is inconvenient.

In the case the intermediate glass transitional temperature of the binder resin of the intermediate layer is not higher than the fuse peak temperature of the polycaprolactone resin by 2° C. or more, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void.

As mentioned above, it is preferable that the intermediate glass transitional temperature of the binder resin of the intermediate layer is higher than the fuse peak temperature of the polycaprolactone resin by 2° C. or more, but the upper limit of the temperature difference thereof is not particularly limited. However, if the temperature difference is more than 100° C., the binder resin is an expensive material in most cases for having an excessive heat resistance so that the production cost of the thermal transfer film can be too high, and thus it is inconvenient.

In the case the number average molecular weight of the binder resin of the intermediate layer is less than 8,000, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void. Moreover, also in the case the number average molecular weight of the binder resin of the intermediate layer is more than 1,000,000, it is difficult to appropriately separate the binder resin and the polycaprolactone resin in the step of drying the coating liquid for providing the intermediate layer after application onto the substrate film so that the effect provided by the polycaprolactone resin being in the supercooling state cannot be obtained substantially, and thus it is difficult to transfer the coloring layer onto the transfer receiving material without generating a void.

Furthermore, by including a carbon black in the intermediate layer, it is difficult to read out the content of the print from the thermal transfer film after printing (to read out the content of the print by the transfer film from a copy obtained by copying the residue of the coloring layer of the thermal transfer film after transfer by a copying machine or the like) so that the classification leakage preventing function can be provided. The inclusion of the carbon black in the intermediate layer is the same as in the above-mentioned first aspect.

The intermediate layer can be formed by mixing the above-mentioned materials with a dispersing agent such as a higher aliphatic alcohol, an ester phosphate and a metal salt thereof, an organic carboxylic acid and a derivative thereof, a low melting point wax, various kinds of surfactant, or the like, as needed, dissolving or dispersing the same in an appropriate solvent, such as methylethyl ketone, toluene, alcohols, water, or the like so as to prepare a coating liquid, coating the same by commonly used coating means, such as a gravure coater, a roll coater, and a wire bar, and drying.

The coating amount of the intermediate layer is preferably about 0.1 to 1.0 g/m$^2$ for the dry solid component. If the coating amount is less than 0.1 g/m$^2$, a vivid printed product without generation of a void can hardly be obtained. In contrast, if the coating amount is more than 1.0 g/m$^2$, the intermediate layer is so thick that the printing sensitivity at the time of transfer is deteriorated, and thus it is not preferable.

(Coloring Layer)

In the present invention, a coloring layer is provided on the above-mentioned intermediate layer. The coloring layer is a thermally fusible ink layer, which may comprise a conventionally known coloring agent and binder, optionally added with an ore oil, a plant oil, a higher aliphatic acid such as stearic acid, and various kinds of additives such as a plasticizer, an antioxidant and a filler.

The binder, the coloring agent, or the like to be used are the same as in the above-mentioned first embodiment. Further, formation of the coloring layer is the same as in the above-mentioned first embodiment.

The thickness of the coloring layer should be determined in balance with the necessary printing density and the heat sensitivity. It is preferably in the range of 0.5 to 8 g/m$^2$, and particularly preferably in the range of 2.5 to 6 g/m$^2$.

Furthermore, with a 150 mPa·s or more and 300 mPa·s or less melt viscosity at 100° C. of the coloring layer, a printed product with further less void can be obtained with respect to a rough paper as in the above-mentioned first embodiment. Moreover, as in the above-mentioned first embodiment, by setting the difference between the fuse peak temperature (the fuse peak temperature defined in the JIS K7121-1987) of the coloring layer and the fuse peak temperature (the fuse peak temperature defined in the JIS K7121-1987) of the polycaprolactone resin at 10° C. or less, a printed product with further little void can be obtained with respect to a rough paper as well as the phenomenon of the coloring layer adhesion like a thin film without sticking onto the surface of the transfer receiving material (entangle phenomenon) can be reduced.

(Heat Resistant Slipping Layer)

Moreover, in order to prevent sticking of a thermal head and to improve the sliding property, a heat resistant slipping layer can be provided on the other surface of the substrate film.

The heat resistant slipping layer can be provided in the same manner as the heat resistant slipping layer described in the above-mentioned first embodiment.

Fourth Embodiment of the Thermal Transfer Film

A thermal transfer film according to the present invention comprises a coloring layer formed on a substrate film via an intermediate layer, wherein the intermediate layer contains a thermally fusible substance having a 100 mPa·s or more and 1,000 mPa·s or less melt viscosity at 75° C., and a non-transferable binder resin having a 130° C. or more and 400° C. or less softening temperature (the softening temperature measured by the ring and ball method defined in the JIS K2207-1980). The crystallization peak temperature defined in the JIS K7121-1987 of the thermally fusible substance is lower than the fuse peak temperature defined in the JIS K7121-1987 of the thermally fusible substance by 10° C. to 50° C.

(Substrate Film)

As a substrate film to be used in a thermal transfer film of the present invention, the substrate films used in the conventional thermal transfer films can be used as well as the other ones can be used, and it is not particularly limited.

As concrete examples of preferable substrate films, those mentioned in the above-mentioned first embodiment can be presented. The thickness thereof is preferably, for example, 3 to 10 $\mu$m.

(Intermediate Layer)

An intermediate layer contains a thermally fusible substance having a 100 mPa·s or more and 1,000 mPa·s or less melt viscosity at 75° C., and a non-transferable binder resin having a 130° C. or more and 400° C. or less softening temperature (the softening temperature measured by the ring and ball method defined in the JIS K2207-1980) as well as the contained thermally fusible substance has a crystallization peak temperature defined in the JIS K7121-1987 lower than the fuse peak temperature defined in the JIS K7121-1987 by 10° C. to 50° C.

Examples of the thermally fusible substance used in the intermediate layer according to the present invention include polyethylene glycol and derivatives thereof, polycaprolactone resins, and polyurethane waxes. However, any one can be used as long as it has a 100 mPa·s or more and 1,000 mPa·s or less melt viscosity at 75° C., and the supercooling property with a temperature difference between the crystallization peak temperature and the fuse peak temperature defined in the JIS K7121-1987 in the range of 10° C. to 50° C.

The melt viscosity can be measured in the present invention with the device mentioned in the above-mentioned first embodiment in the same manner.

As the above-mentioned polyethylene glycol, a polyethylene glycol derivative having about 3,000 to 5,000 molecular weight can be used preferably.

The polycaprolactone resin is a resin having a repeated structure obtained by polymerization of $\epsilon$-caprolactone monomers (existing chemical substance No. 5-1091), such as polycaprolactone diol and polycaprolactone triol (existing chemical substance No. 7-808).

The hydroxyl group at the end of the above-mentioned polyethylene glycol can be substituted by various groups. Moreover, a polyester substance, a silicone substance or a polyamide substance can also be used preferably as long as it has the above-mentioned physical properties.

The thermally fusible substance has a crystallization peak temperature (the crystallization peak temperature defined in the JIS K7121-1987) lower than the fuse peak temperature (the fuse peak temperature defined in the JIS K7121-1987) of the same thermally fusible substance by 10° C. to 50° C.

If the above-mentioned temperature difference between the crystallization peak temperature and the fuse peak temperature is less than 10° C., the supercooling property of the thermally fusible substance is weakened so that the low viscosity thermally fusible substance fused after the printing heating is crystallized and aggregated, or the low viscosity thermally fusible substance fused after the printing heating has the viscosity rise according to the temperature drop, and thus a void is generated in the printed product and a vivid print cannot be obtained. In contrast, if the temperature difference between the crystallization peak temperature and the fuse peak temperature is more than 50° C., since the state with the thermally fusible substance fused by the heat continues excessively after heat drying of the intermediate layer in applying the ink for providing the intermediate layer on the substrate film, the substrate film surface (the opposite side with respect to the intermediate layer formation side) and the intermediate layer surface of the thermal transfer film wound up after the application are bonded, and thus it is inconvenient.

As to the concrete numerical values of the crystallization and the fuse peak temperature, for example, about 45° C. to 70° C. fuse peak temperature defined in the JIS K7121-1987 of the thermally fusible substance can be presented. If the fuse peak temperature is too high, the sensitivity is insufficient. In contrast, the fuse peak temperature is too low, the inconvenience of bonding of the substrate film surface and the intermediate layer surface of the thermal transfer film wound up after applying the ink for providing the intermediate layer onto the substrate film can easily be generated.

In the intermediate layer of the thermal transfer film according to the present invention, it is important that the binder resin is not fused at the time of printing heating so as to remain on the substrate film side of the thermal transfer film without being thermally transferred to the transfer receiving material.

Therefore, it is preferable that the binder resin and the thermally fusible substance are incompatible. That is, in an intermediate layer according to the present invention, wherein a thermally fusible substance and a binder resin are contained, it is important to provide the intermediate layer without a substantial change in the crystallization peak temperature and the fuse peak temperature of the thermally fusible substance itself even when the thermally fusible substance is mixed with the binder resin. Therefore, it is preferable to produce the state wherein the thermally fusible substance is disposed in the pores of the porous film formed with the binder resin as a main material.

The above-mentioned incompatibility of the thermally fusible substance and the binder resin is the same as the incompatibility of the polycaprolactone resin and the binder resin explained in the first embodiment.

In the present invention, as mentioned above, it is preferable that the intermediate layer comprises a porous structure. Since the binder resin forms a mesh-like porous film, it is not fused in printing heating so as to remain on the substrate film side of the thermal transfer film without being thermally transferred to the transfer receiving material.

Moreover, the thermally fusible substance is contained in the pores surrounded by the porous film so that the thermally fusible substance is transferred to the transfer receiving material at the time of printing heating in the state with a low melt viscosity. Even if the intermediate layer is cooled to some extent from printing to peeling off, owing to the supercooling property of the thermally fusible substance, the transfer receiving material and the thermal transfer film can be peeled off with the intermediate layer in the fused state. Accordingly, the domain of the coloring layer applied with the energy can be transferred to the transfer receiving material without generating a void so that a preferable printed product with little void can be obtained even with respect to a rough paper as the transfer receiving material.

Therefore, as mentioned above, it is preferable that the intermediate layer contains a thermally fusible substance having a 100 mPa·s or more and 1,000 mPa·s or less melt viscosity at 75° C., and a binder resin having a 130° C. or more and 400° C. or less softening temperature measured by the ring and ball method defined in the JIS K2207-1980 as the main components as mentioned above, the binder resin and the thermally fusible substance are incompatible, and the binder resin forms a porous structure as a layer.

If the melt viscosity at 75° C. of the thermally fusible substance used in the present invention is more than 1,000 mPa·s, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void. Moreover, even in the case the binder resin and the thermally fusible substance are separated appropriately, if the melt viscosity at 75° C. of the thermally fusible substance is more than 1,000 mPa·s, the flowability of the thermally fusible substance to be in the fused state (a liquid state) subject to the application of an energy by printing as is insufficient at the time of peeling off the transfer receiving material and the thermal transfer film, and thus it is difficult to transfer the coloring layer onto the transfer receiving material without generating a void.

If the melt viscosity at 75° C. of the thermally fusible substance is less than 100 mPa·s, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void. Moreover, even in the case the binder resin and the thermally fusible substance are separated appropriately, it is difficult to overcoat the coloring layer stably with a good surface quality at the time of applying the coloring layer on the substrate film provided with the intermediate layer by the hot melt coating method.

The porous film in the present invention can be a film with either a porous structure observable by naked eyes, an optical microscope, a scanning electron microscope, a transmission electron microscope or a confocal laser microscope, or an extremely fine porous structure not observable with these equipments.

As a binder resin having a 130° C. or more and 400° C. or less softening temperature measured by the ring and ball method defined in the JIS K2207-1980, any resin can be used as long as it is non-transferable and is capable of maintaining the film forming property without having a low viscosity at the time of coating the coloring layer on the intermediate layer formed on the substrate film and at the time of the printing heating. In particular, a resin incompatible with a polycaprolactone resin is preferable. Examples thereof include: polyester resins; polybutadiene resins such as SBR resins, ABS resins, and SBS resins; maleic acid resins such as styrene-maleic anhydride copolymers; olefin resins; olefin copolymers; ionomer resins; and styrene resins.

In the case the softening temperature (the softening temperature measured by the ring and ball method defined in the JIS K2207-1980) of the binder resin is lower than 130° C., it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void.

Furthermore, since a binder resin having an softening temperature (the softening temperature measured by the ring and ball method defined in the JIS K2207-1980) more than 400° C. is an expensive material in most cases for having an excessive heat resistance, the production cost of the thermal transfer film can be too high, and thus it is inconvenient.

In the present invention, it is preferable that the intermediate glass transitional temperature defined in the JIS K7121-1987 of the binder resin of the intermediate layer is higher than the fuse peak temperature (the fuse peak temperature defined in the JIS K7121-1987) of the thermally fusible substance by 2° C. or more, but the upper limit of the temperature difference thereof is not particularly limited. However, if the temperature difference is more than 100° C., the binder resin is an expensive material In most cases for having an excessive heat resistance so that the production cost of the thermal transfer film can be too high, and thus it is inconvenient.

In the case the intermediate glass transitional temperature of the binder resin of the intermediate layer is not higher than the fuse peak temperature of the thermally fusible substance by 2° C. or more, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void.

Furthermore, the number average molecular weight of the binder resin of the intermediate layer is preferably 8,000 or more and 1,000,000 or less, and is particularly preferably 8,000 or more and 100,000 or less.

In the case the number average molecular weight of the binder resin of the intermediate layer is less than 8,000, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void. Moreover, also in the case the number average molecular weight of the binder resin of the intermediate layer is more than 1,000,000, it is difficult to appropriately separate the binder resin and the thermally fusible substance in the step of drying the coating liquid for providing the intermediate layer after application onto the substrate film so that the effect provided by the thermally fusible substance being in the supercooling state cannot be obtained substantially, and thus it is difficult to transfer the coloring layer onto the transfer receiving material without generating a void.

Furthermore, by including a carbon black in the intermediate layer, it is difficult to read out the content of the print from the thermal transfer film after printing (to read out the content of the print by the transfer film from a copy obtained by copying the residue of the coloring layer of the thermal transfer film after transfer by a copying machine or the like) so that the classification leakage preventing function can be provided. The inclusion of the carbon black in the intermediate layer is the same as in the above-mentioned first aspect.

The intermediate layer can be formed by mixing the above-mentioned materials with a dispersing agent such as a higher aliphatic alcohol, an ester phosphate and a metal salt thereof, an organic carboxylic acid and a derivative thereof, a low melting point wax, various kinds of surfactant or the like, as needed, dissolving or dispersing the same in an appropriate solvent, such as methylethyl ketone, toluene, alcohols, water, or the like so as to prepare a coating liquid, coating the same by commonly used coating means, such as a gravure coater, a roll coater, and a wire bar, and drying.

The coating amount of the intermediate layer is preferably about 0.1 to 1.0 g/m$^2$ for the dry solid component. If the coating amount is less than 0.1 g/m$^2$, a vivid printed product without generation of a void can hardly be obtained. In contrast, if the coating amount is more than 1.0 g/m$^2$, the intermediate layer is so thick that the printing sensitivity at the time of transfer is deteriorated, and thus It is not preferable.

(Coloring Layer)

In the present invention, a coloring layer is provided on the above-mentioned intermediate layer. The coloring layer is a thermally fusible ink layer, which may comprises a conventionally known coloring agent and binder, optionally added with an ore oil, a plant oil, a higher aliphatic acid such as stearic acid, and various kinds of additives such as a plasticizer, an antioxidant and a filler.

The binder, the coloring agent, or the like to be used are the same as in the above-mentioned first embodiment. Further, formation of the coloring layer is the same as in the above-mentioned first embodiment.

The thickness of the coloring layer should be determined in balance with the necessary printing density and the heat sensitivity. It is preferably in the range of 0.5 to 8 g/m$^2$, and particularly preferably in the range of 2.5 to 6 g/m$^2$.

Furthermore, with a 150 mPa·s or more and 300 mPa·s or less melt viscosity at 100° C. of the coloring layer, a printed product with further less void can be obtained with respect to a rough paper as in the above-mentioned first embodiment. Moreover, as in the above-mentioned first embodiment, by setting the difference between the fuse peak temperature (the fuse peak temperature defined in the JIS K7121-1987) of the coloring layer and the fuse peak temperature (the fuse peak temperature defined in the JIS K7121-1987) of the thermally fusible substance at 10° C. or less, a printed product with further little void can be obtained with respect to a rough paper as well as the phenomenon of the coloring layer adhesion like a thin film without sticking onto the surface of the transfer receiving material (entangle phenomenon) can be reduced.

(Heat Resistant Slipping Layer)

Moreover, in order to prevent sticking of a thermal head and to improve the sliding property, a heat resistant slipping layer can be provided on the other surface of the substrate film.

The heat resistant slipping layer can be provided in the same manner as the heat resistant slipping layer described in the above-mentioned first embodiment.

Image Forming Method According to the Present Invention

An image forming method according to the present invention comprises the steps of superimposing a transfer receiving material onto the coloring layer surface of the thermal transfer film according to the first embodiment or the third embodiment, heating and recording from the substrate film side like pixels by heating means, and separating the thermal transfer film and the transfer receiving material, wherein the time from recording the pixels to separating the thermal transfer film and the transfer receiving material is 0.05 second or more and 2 seconds or less. If the separation time is at less than 0.05 second, the printing defect such as blur of the print can easily be generated. In contrast, if the separation time is at more than 2 seconds, the supercooling property of the polycaprolactone resin is still insufficient, and thus the low viscosity polycaprolactone resin fused after the printing heating is aggregated, or the low viscosity polycaprolactone resin fused after the printing heating has the viscosity rise according to the temperature drop, and thus a void is generated in the printed product and a vivid print cannot be obtained.

Moreover, an image forming method according to the present invention comprises the steps of superimposing a transfer receiving material onto the coloring layer surface of the thermal transfer film according to the second embodiment or the fourth embodiment, heating and recording from the substrate film side like pixels by heating means, and separating the thermal transfer film and the transfer receiving material, wherein the time from recording the pixels to separating the thermal transfer film and the transfer receiving material is 2 seconds or less. If the separation time is at more than 2 seconds, the supercooling property of the thermally fusible substance is still insufficient, and thus the low viscosity thermally fusible substance fused after the printing heating is aggregated, or the low viscosity thermally fusible substance fused after the printing heating has the viscosity rise according to the temperature drop, and thus a void is generated in the printed product and a vivid print cannot be obtained.

As the heating means in the above-mentioned image formation, a conventionally known method capable of controlling the heating amount according to the image information from a computer can be used. For example, a thermal head used in word processors and facsimiles, and a laser head used in laser print type printers can be used. Furthermore, in the case a conductive heat generating layer is provided on the rear surface side of the thermal transfer film, a conductive heating type fuse transfer method conductive head can also be used.

In the case a thermal head is used as the heating means, it is preferable to use an entire surface glaze type thermal head or a partial glaze type thermal head, wherein a heat generating member is formed not on the end face but on the flat surface region of an alumina substrate, since the price of the thermal head itself is drastically lower than that of a end face type thermal head described later for providing an image forming apparatus at a low cost. In the case such an entire surface glaze type thermal head or a partial glaze type thermal head is used, since a region for providing a common electrode and a base for supporting the alumina substrate exists with about 1 mm to 10 mm width at the downstream side with respect to the heat generating member in the feeding direction of the thermal transfer film, it is difficult to keep a space necessary for separating the thermal transfer film from the transfer receiving material immediately after recording pixels. Therefore, the separation can be enabled after moving the region of the pixels heated and recorded by the thermal head to the downstream side in the thermal transfer film feeding direction ahead the end part of the alumina substrate.

In the case an image forming method of the present invention is executed with an image forming apparatus using the above-mentioned entire surface glaze type thermal head or partial glaze type thermal head, the shortest time for moving the region of the pixels heated and recorded by the thermal head to the downstream side in the feeding direction of the thermal transfer film to the end part of the substrate is the minimum time for separating the thermal transfer film and the transfer receiving material. The time for separating the thermal transfer film and the transfer receiving material can be 2 seconds or less by optionally adjusting the feeding rate in the case the thermal transfer film is fed continuously, or by optionally adjusting the stopping time and the feeding rate in the case the thermal transfer film is fed intermittently.

In contrast, in the case an image forming method of the present invention is executed with an image forming apparatus using the above-mentioned entire surface glaze type thermal head or partial glaze type thermal head, it is difficult to have a 0 second separation time according to the above-mentioned reason. In order to have a 0 second separation time in the case a thermal head is used as the heating means, the transfer receiving material and the thermal transfer film should be separated immediately after recording the pixels. Such a separation can be enabled by using the so-called end face type thermal head, wherein a heat generating member is formed on the end face portion of an alumina substrate.

In the present invention, the energy for heating and recording for the image formation is preferably 10 mJ/mm$^2$ or more and 35 mJ/mm$^2$ or less. If the heating energy is less than 10 mJ/mm$^2$, transfer of the coloring layer onto the transfer receiving material is insufficient, and thus a vivid printing cannot be executed. In contrast, if the heating energy is more than 35 mJ/mm$^2$, the polycaprolactone resin of the intermediate layer is mixed with the fused coloring layer so that a vivid printed product without the void generation can hardly be obtained, and thus it is not preferable.

It is needless to say that the thermal transfer film according to the present invention can be adopted to a color printing, as well as a multi-color thermal transfer film is included in the scope of the present invention.

The thermal transfer film according to the present invention is not limited to the above-mentioned embodiments.

Moreover, as the transfer receiving material used in combination with the thermal transfer film according to the present invention, any conventionally known member to be transferred can be used.

EXAMPLES

Hereinafter the present invention will be explained further specifically with reference to examples and comparative examples. The "part" or "%" in the explanation below is based on the weight unless otherwise specified.

Example 1

Production of Samples 1-1 to 1-8

An intermediate layer coating liquid with the composition shown in Table 1 was coated on a substrate film comprising a 4.5 $\mu$m thickness polyethylene terephthalate film (produced by Toray Industries, Inc.) by a gravure coating method with the application amount each shown in Table 1. After drying the solvent by a 100° C. hot air, it was wound up. The melt viscosity was measured with the following measuring device and the measuring conditions.

Device name: Viscoelasticity measuring device Rotobisuco RV20 (Produced by HAKKE Corp.)

Measuring head part: M5

Sensor system: Sensor System Cone Plate PK5 (open angle 0.5°, cone plate radius 25 mm, set temperature 75° C.).

Then, a coloring layer coating liquid with the below-mentioned composition was applied on each intermediate layer by a hot melt coating method heated to 100° C. by a 4 μm thickness in the dry state so as to form a coloring layer for producing thermal transfer films (samples 1-1 to 1-8).

A heat resistant slipping layer coating liquid with the below-mentioned composition was applied by a roll coater and dried on the other surface of the substrate film so as to provide a heat resistant slipping layer preliminarily by a 0.1 μm thickness in the dry state.

<Coloring Layer Coating Liquid>

Carbon black (average particle size 40 nm, produced by Mitsubishi Chemical Corp.): 15 parts Ethylene-vinyl acetate copolymer (SUMITETO HC10 produced by Sumitomo Chemical Co., Ltd.): 9 parts Carnauba wax (Kato Yoko Corp.): 38 parts Paraffin wax (155° F., produced by Nihon Seiro Co., Ltd.): 38 parts <Heat Resistant Slipping Layer Coating Liquid>

Polyvinyl butylal resin (ESLEC BX-1 produced by Sekisui Chemical Co., Ltd.): 20 parts Talc (MICROACE L-1 produced by Nihon Talc Corp.): 30 parts Melamine resin fine particles (EPOSTAR S produced by Nihon Shokubai Chemical Industries): 30 parts Polyisocyanate (TAKENATE A-3 produced by Takeda Medicine Industries, Ltd.): 40 parts Toluene/methylethyl ketone (weight ratio 1/1): 900 parts

TABLE 1

| | Kind | Parts by Weight | Caprolactone Resin: Melt Viscosity (mPa's) (75° C.) | Number Average Molecular Weight | Fuse Peak Temperature (° C.) |
|---|---|---|---|---|---|
| Sample | | | | | |
| 1-1 | (2) | 75 | 330–400 | 2,000 | 53–55 |
| 1-2 | (1) | 75 | 110–130 | 1,000 | 46–48 |
| 1-3 | (2) | 75 | 330–400 | 2,000 | 53–55 |
| 1-4 | (2) | 75 | 330–400 | 2,000 | 53–55 |
| 1-5 | (2) | 75 | 330–400 | 2,000 | 53–55 |
| 1-6 | (2) | 20 | 330–400 | 2,000 | 53–55 |
| 1-7 | (2) | 60 | 330–400 | 2,000 | 53–55 |
| 1-8 | (2) | 20 | 330–400 | 2,000 | 53–55 |
| Comparative Sample | | | | | |
| 1-1 | (2) | 100 | 330–400 | 2,000 | 53–55 |
| 1-2 | (3) | 100 | 1450–1650 | 4,000 | 55–58 |
| 1-3 | (4) | 100 | 250,000–300,000 | 10,000 | 60 |
| 1-4 | (5) | 100 | 200–400 | 2,000 | 40–45 |
| 1-5 | (4) | 30 | 250,000–300,000 | 10,000 | 60 |
| 1-6 | (4) | 30 | 250,000–300,000 | 10,000 | 60 |
| 1-7 | (2) | 30 | 330–400 | 2,000 | 53–55 |
| 1-8 | (4)/(3) = 2/1 | 100 | 200,000–250,000 | 8,000 | 60 |
| 1-9 | (14) | 100 | 2,000,000–2,500,000 | 70,000 | 60 |
| 1-10 | (9) | 75 | 30–50 | 530 | 30–40 |
| 1-11 | (3) | 75 | 1450–1650 | 4,000 | 55–58 |
| 1-12 | (9) | 75 | 30–50 | 530 | 30–40 |
| 1-13 | (3) | 75 | 1450–1650 | 4,000 | 55–58 |

TABLE 1-continued

| | Kind | Parts by Weight | Binder Resin: Intermediate Glass Transitional temperature (° C.) | Extrapolation Fuse Starting Temperature (° C.) | Number Average Molecular Weight |
|---|---|---|---|---|---|
| Sample | | | | | |
| 1-1 | (12) | 25 | 47 | 140° C. ≦ | 14,000–17,000 |
| 1-2 | (10) | 25 | 53 | 140° C. ≦ | 4,000 |
| 1-3 | (13) | 25 | 100 | 140° C. ≦ | 10,000 |
| 1-4 | (6) | 25 | 67 | 140° C. ≦ | 15,000–20,000 |
| 1-5 | (11) | 25 | 72 | 140° C. ≦ | 20,000–25,000 |
| 1-6 | (6) | 60 | 67 | 140° C. ≦ | 15,000–20,000 |
| 1-7 | (6) | 20 | 67 | 140° C. ≦ | 15,000–20,000 |
| 1-8 | (6) | 40 | 67 | 140° C. ≦ | 15,000–20,000 |
| Comparative Sample | | | | | |
| 1-1 | — | — | — | — | — |
| 1-2 | — | — | — | — | — |
| 1-3 | — | — | — | — | — |
| 1-4 | — | — | — | — | — |
| 1-5 | (6) | 70 | 67 | 140° C. ≦ | 15,000–20,000 |
| 1-6 | (7) | 70 | — | 75° C. | — |
| 1-7 | (7) | 70 | — | 75° C. | — |
| 1-8 | — | — | — | — | — |
| 1-9 | — | — | — | — | — |
| 1-10 | (12) | 25 | 47 | — | 14,000–17,000 |
| 1-11 | (12) | 25 | 47 | — | 14,000–17,000 |
| 1-12 | (6) | 25 | 67 | — | 15,000–20,000 |
| 1-13 | (6) | 25 | 67 | — | 15,000–20,000 |

| | Kind | Parts by Weight | Carbon Black Solvent: Kind | Parts by Weight | Application Amount (g/m$^2$) |
|---|---|---|---|---|---|
| Sample | | | | | |
| 1-1 | — | — | Toluene | 900 | 0.5 |
| 1-2 | — | — | Toluene | 900 | 0.5 |
| 1-3 | — | — | Toluene | 900 | 0.5 |
| 1-4 | — | — | Toluene | 900 | 0.5 |
| 1-5 | — | — | Toluene | 900 | 0.5 |
| 1-6 | (8) | 20 | Toluene | 900 | 0.5 |
| 1-7 | (8) | 20 | Toluene | 900 | 0.5 |
| 1-8 | (8) | 40 | Toluene | 900 | 0.5 |
| Comparative Sample | | | | | |
| 1-1 | — | — | Toluene | 900 | 1.0 |
| 1-2 | — | — | Toluene | 900 | 1.0 |
| 1-3 | — | — | Toluene | 900 | 1.0 |
| 1-4 | — | — | Toluene | 900 | 1.0 |
| 1-5 | — | — | Toluene | 900 | 0.5 |
| 1-6 | — | — | Toluene | 900 | 1.0 |
| 1-7 | — | — | Toluene | 900 | 1.0 |
| 1-8 | — | — | Toluene | 900 | 1.0 |
| 1-9 | — | — | Toluene | 900 | 2.0 |
| 1-10 | — | — | Toluene | 900 | 0.5 |
| 1-11 | — | — | Toluene | 900 | 0.5 |
| 1-12 | — | — | Toluene | 900 | 0.5 |
| 1-13 | — | — | Toluene | 900 | 0.5 |

The kinds of the used polycaprolactone resin, binder resin, and carbon black are as follows:

(1) PLACCEL 210 (polycaprolactone diol, produced by Daicel Chemical Industries, Ltd.)
(2) PLACCEL 220 (polycaprolactone diol, produced by Daicel Chemical Industries, Ltd.)
(3) PLACCEL 240 (polycaprolactone diol, produced by Daicel Chemical Industries, Ltd.)
(4) PLACCEL H1P (polycaprolactone, produced by Daicel Chemical Industries, Ltd.)
(5) PLACCEL 320 (polycaprolactone triol, produced by Daicel Chemical Industries, Ltd.)
(6) VYLON 200 (produced by Toyoboseki Co., Ltd.)
(7) Carnauba No. 2 (carnauba wax, produced by Noda Wax)
(8) Carbon black (average particle size 40 nm, produced by Mitsubishi Chemical Corp.)
(9) PLACCEL 205 (polycaprolactone diol, produced by Daicel Chemical Industries, Ltd.)
(10) VYLON 220 (produced by Toyoboseki Co., Ltd.)
(11) VYLON 290 (produced by Toyoboseki Co., Ltd.)
(12) VYLON 600 (produced by Toyoboseki Co., Ltd.)
(13) Polystyrene (number average molecular weight 10,000)
(14) PLACCEL H7 (polycaprolactone, produced by Daicel Chemical Industries, Ltd.).

Production of Comparative Samples 1-1 to 1-13

In the same process as the above-mentioned samples 1-1 to 1-8 except that an intermediate layer coating liquid with the composition shown in Table 1 were used with the application amount each shown in Table 1, thermal transfer films (comparative samples 1-1 to 1-13) were produced.

The thermal transfer films obtained as mentioned above (samples 1-1 to 1-8, and comparative samples 1-1 to 1-13) were evaluated for the coating suitability of the intermediate layer, the coating suitability of the coloring layer, the printing quality and the classification leakage preventing property by the below-mentioned evaluation methods.

<Coating Suitability of the Intermediate Layer>

The coating suitability at the time of applying the intermediate layer on the substrate film was evaluated according to the following evaluation standard.

A: In the intermediate layer after drying the solvent, a tack at the time of contacting with a finger cannot be observed, and the substrate film surface and the intermediate layer after winding up are not bonded due to the tack of the intermediate layer.

B: In the intermediate layer after drying the solvent, although a tack at the time of contacting with a finger can be observed slightly, the substrate film surface and the intermediate layer after winding up are not bonded due to the tack of the intermediate layer.

C: In the intermediate layer after drying the solvent, a tack at the time of contacting with a finger can be observed, and further, bonding of the substrate film surface and the intermediate layer after winding up due to the tack of the intermediate layer was observed.

<Coating Suitability of the Coloring Layer>

The coating suitability at the time of applying a coloring layer coating liquid on the intermediate layer was evaluated according to the following evaluation standard.

A: A coating surface of the good quality equivalent to the case of directly coating the coloring layer coating liquid onto the substrate film is obtained.

B: A coating surface with a considerable irregularity compared with the case of directly coating the coloring layer coating liquid onto the substrate film is obtained.

C: A coating surface with a drastic irregularity, incapable of being provided for the practical use as a thermal transfer film is obtained.

<Printing Quality>

With a facsimile produced by Fuji Xerox Corp. (Telecopier 7033), a copy mode printing was executed onto a printer paper produced by Xerox Corp. (#4024, beck smoothness 32 seconds), using the above-mentioned thermal transfer films.

The obtained printed product was observed visually, and lack of characters or fine lines caused by a generated void was evaluated according to the following standard.

A: Lack of characters or fine lines caused by a generated void is hardly observed, and an extremely good printed product is obtained.

B: Although slight lack of characters or fine lines caused by a generated void is observed, a good printed product is obtained.

C: Lack of characters and fine lines caused by a generated void is observed considerably, and a printed product with characters and fine lines having a blurred appearance is obtained.

D: Lack of characters and fine lines caused by a generated void is observed remarkably, and a printed product with characters and fine lines having an extremely blurred appearance is obtained.

<Classification Leakage Preventing Property>

The coloring layer surface of the thermal transfer film after printing with the same condition as in the above-mentioned printing quality condition was copied onto a copy paper produced by Fuji Xerox Corp. (WR-100) by a copying machine produced by Fuji Xerox Corp. (Vivace 675). The concentration setting at the time of copying was "automatic". The image copied on the copy paper was observed visually, and whether the content of the print with the thermal transfer film can be read out was evaluated according to the following standard.

A: The content of the print cannot be read out.

B: The content of the print can hardly be read out.

C: The content of the print can easily be read out.

<Evaluation Result>

Evaluation results are shown in Table 2.

TABLE 2

| | Coating Suitability of Intermediate layer | Coating Suitability of Coloring Layer | Printing Quality | classification leakage preventing property |
|---|---|---|---|---|
| | | Sample | | |
| 1-1 | B | A | A | C |
| 1-2 | B | A | A | C |
| 1-3 | A | A | B | C |
| 1-4 | A | A | A | C |
| 1-5 | A | A | A | C |
| 1-6 | A | A | A | B |
| 1-7 | A | A | A | B |
| 1-8 | A | A | A | A |
| | | Comparative Sample | | |
| 1-1 | C | C | D | C |
| 1-2 | C | C | D | C |
| 1-3 | C | B | D | C |
| 1-4 | C | C | D | C |
| 1-5 | A | A | D | C |
| 1-6 | C | C | D | C |
| 1-7 | C | C | D | C |
| 1-8 | C | B | D | C |
| 1-9 | C | B | D | C |
| 1-10 | C | C | C | C |
| 1-11 | C | C | C | C |

TABLE 2-continued

| | Coating Suitability of Intermediate layer | Coating Suitability of Coloring Layer | Printing Quality | classification leakage preventing property |
|---|---|---|---|---|
| 1-12 | B | C | C | C |
| 1-13 | B | A | C | C |

As shown in Table 2, it is confirmed that the thermal transfer films (samples 1-1 to 1-8) using a polycaprolactone resin having a 100 mPa·s or more and 1,000 mPa·s or less melt viscosity at 75° C., and a binder resin having a 130° C. or more and 400° C. or less extrapolation fuse starting temperature are at the level sufficient for the practical use in all of the items including the coating suitability of the intermediate layer, the coating suitability of the coloring layer, and the printing quality, and further, that the thermal transfer films (samples 1-6 to 1-8) containing a carbon black in the intermediate layer have also the excellent classification leakage preventing property.

In contrast, the thermal transfer films (comparative samples 1-2, 1-3, 1-5, 1-6, and 1-8 to 1-13) using a polycaprolactone resin having a melt viscosity outside the range of 100 mPa·s to 1,000 mPa·s at 75° C., the thermal transfer films (comparative samples 1-1 to 1-4, 1-8, 1-9) not containing a binder resin in the intermediate layer, and the thermal transfer films (comparative samples 1-6, 1-7) containing a binder resin having an extrapolation fuse starting temperature less than 130° C. are not sufficient for the practical use at least in one item from the coating suitability of the intermediate layer, the coating suitability of the coloring layer, and the printing quality.

Then, with a test printer using a thermal head produced by Rohm Co., Ltd. (KF2008-GR10A, applied voltage 24V), a printing operation was executed with the thermal transfer film produced as mentioned above (sample 1-8) onto a printer paper produced by Xerox Corp. (#4024, beck smoothness 32 seconds) at a 10 ms/line printing rate with 16 kinds of printing conditions according to combination of a peeling time and an applied energy shown in Table 3 (printing conditions A-1 to A-8, comparative printing conditions A-1 to A-8).

The applied energy was adjusted by optionally changing the length of the applied pulse, and the peeling time was adjusted by optionally changing the distance from the center position of the heat generating member of the thermal head to the peeling position.

Moreover, the printing quality evaluation was executed according to the evaluation standard used for the above-mentioned samples 1-1 to 1-8 and comparative samples 1-1 to 1-13.

<Evaluation Result>

Evaluation results are shown in Table 3.

TABLE 3

| | Peeling Time (sec.) | Applied Energy (mJ/mm$^2$) | Printing Quality |
|---|---|---|---|
| | Printing Condition | | |
| A-1 | 0.1 | 5 | B |
| A-2 | 0.1 | 15 | A |
| A-3 | 0.1 | 30 | A |

TABLE 3-continued

| | Peeling Time (sec.) | Applied Energy (mJ/mm$^2$) | Printing Quality |
|---|---|---|---|
| A-4 | 0.1 | 40 | B |
| A-5 | 1.5 | 5 | B |
| A-6 | 1.5 | 15 | A |
| A-7 | 1.5 | 30 | A |
| A-8 | 1.5 | 40 | B |
| | Comparative Printing Condition | | |
| A-1 | 0.02 | 5 | D |
| A-2 | 0.02 | 15 | C |
| A-3 | 0.02 | 30 | C |
| A-4 | 0.02 | 40 | D |
| A-5 | 3 | 5 | D |
| A-6 | 3 | 15 | C |
| A-7 | 3 | 30 | C |
| A-8 | 3 | 40 | D |

As shown in Table 3, the printing quality of the ones printed by the printing conditions A-1 to A-8 with the time from recording the pixels to separating the thermal transfer film and the printer paper in the range of 0.05 to 2 seconds have a good printing quality. Among them, those printed by the printing conditions A-2, A-3, A-6, and A-7 with the printing energy in the range of 10 to 35 mJ/mm$^2$ have a particularly good printing quality.

In contrast, ones printed by the comparative printing conditions A-1 to A-8 with the time from recording the pixels to separating the thermal transfer film and the printer paper of less than 0.05 second or more than 2 seconds have a poor printing quality. Among them, those printed by the comparative printing conditions A-1, A-4, A-5, and A-8 with the printing energy outside the range of 10 to 35 mJ/mm$^2$ have a particularly poor printing quality.

Example 2

Production of Samples 2-1 to 2-11

An intermediate layer coating liquid with the composition shown in Table 4 was coated on a substrate film comprising a 4.5 $\mu$m thickness polyethylene terephthalate film (produced by Toray Industries, Inc.) by a gravure coating method with the application amount each shown in Table 4. After drying the solvent by a 100° C. hot air, it was wound up. The melt viscosity was measured with the same measuring device and measuring conditions as in the example 1.

Then, a coloring layer coating liquid with the below-mentioned composition was applied on each intermediate layer by a hot melt coating method heated to 100° C. by a 4 $\mu$m thickness in the dry state so as to form a coloring layer for producing thermal transfer films (samples 2-1 to 2-11).

A heat resistant slipping layer coating liquid with the below-mentioned composition was applied by a roll coater and dried on the other surface of the substrate film so as to provide a heat resistant slipping layer preliminarily by a 0.1 $\mu$m thickness in the dry state.

<Coloring Layer Coating Liquid>

- Carbon black (average particle size 40 nm, produced by Mitsubishi Chemical Corp.): 15 parts
- Ethylene-vinyl acetate copolymer (SUMITETO HC10 produced by Sumitomo Chemical Co., Ltd.): 9 parts
- Carnauba wax (Kato Yoko Corp.): 38 parts
- Paraffin wax (155° F., produced by Nihon Seiro Co., Ltd.): 38 parts <Heat Resistant Slipping Layer Coating Liquid>

Polyvinyl butyral resin (ESLEC BX-1 produced by Sekisui Chemical Co., Ltd.): 20 parts Talc (MICROACE L-1 produced by Nihon Talc Corp.): 30 parts Melamine resin fine particles (EPOSTAR S produced by Nihon Shokubai Chemical Industry Corp.): 30 parts Polyisocyanate (TAKENATE A-3 produced by Takeda Medicine Industries, Ltd.): 40 parts Toluene/methylethyl ketone (weight ratio 1/1): 900 parts

TABLE 4

| | Thermally Fusible Substance | | | | | | |
|---|---|---|---|---|---|---|---|
| | | | | | A: Fuse Peak Temp. (° C.) B: Crystallization Peak Temp. (° C.) (A − B): Difference between A and B (° C.) | | |
| | Kind | Parts by Weight | Melt Viscosity (mPa · s) (75° C.) | Number Average Molecular Weight | A | B | (A − B) |
| Sample | | | | | | | |
| 2-1 | (1) | 75 | 250–300 | 4,000 | 57–58 | 32–34 | 23–26 |
| 2-2 | (3) | 75 | 330–400 | 2,000 | 53–55 | 27–29 | 24–28 |
| 2-3 | (2) | 75 | 110–130 | 1,000 | 46–48 | 20–22 | 24–28 |
| 2-4 | (3) | 75 | 330–400 | 2,000 | 53–55 | 27–29 | 24–28 |
| 2-5 | (3) | 75 | 330–400 | 2,000 | 53–55 | 27–29 | 24–28 |
| 2-6 | (3) | 75 | 330–400 | 2,000 | 53–55 | 27–29 | 24–28 |
| 2-7 | (3) | 20 | 330–400 | 2,000 | 53–55 | 27–29 | 24–28 |
| 2-8 | (3) | 60 | 330–400 | 2,000 | 53–55 | 27–29 | 24–28 |
| 2-9 | (3) | 20 | 330–400 | 2,000 | 53–55 | 27–29 | 24–28 |
| 2-10 | (1) | 40 | 250–300 | 4,000 | 57–58 | 32–34 | 23–26 |
| 2-11 | (1) | 40 | 180–220 | 4,000 | 57–58 | 32–34 | 23–26 |
| Comparative Sample | | | | | | | |
| 2-1 | (1) | 75 | 250–300 | 4,000 | 58–60 | 32–34 | 23–26 |
| 2-2 | (3) | 100 | 330–400 | 2,000 | 53–55 | 27–29 | 24–28 |
| 2-3 | (4) | 100 | 1450–1650 | 4,000 | 55–58 | 29–33 | 22–29 |
| 2-4 | (5) | 100 | 250,000–300,000 | 10,000 | 60 | 31–32 | 28–29 |
| 2-5 | (6) | 100 | 200–400 | 2,000 | 40–45 | 17–20 | 24–28 |
| 2-6 | (5) | 30 | 250,000–300,000 | 10,000 | 60 | 31–32 | 28–29 |
| 2-7 | (5) | 30 | 250,000–300,000 | 10,000 | 60 | 31–32 | 28–29 |
| 2-8 | (3) | 30 | 330–400 | 2,000 | 53–55 | 27–29 | 24–28 |
| 2-9 | (5)/(4) = 2/1 | 100 | 200,000–250,000 | 8,000 | 60 | 30–32 | 28–30 |
| 2-10 | (15) | 100 | 2,000,000–2,500,000 | 70,000 | 60 | 31–32 | 28–29 |
| 2-11 | (10) | 75 | 30–50 | 530 | 30–40 | 15–20 | 10–25 |
| 2-12 | (4) | 75 | 1450–1650 | 4,000 | 55–58 | 29–33 | 22–29 |
| 2-13 | (10) | 75 | 30–50 | 530 | 30–40 | 15–20 | 10–25 |
| 2-14 | (4) | 75 | 1450–1650 | 4,000 | 55–58 | 29–33 | 22–29 |
| 2-15 | (1) | 75 | 180–220 | 4,000 | 57–58 | 32–34 | 23–26 |
| 2-16 | (19) | 75 | 180–220 | 330 | 55–60 | −10–0 | 65–70 |

| | Binder Resin | | | | |
|---|---|---|---|---|---|
| | Kind | Solid component Parts by Weight | Intermediate Glass Transitional temperature (° C.) | Extrapolation Fuse Starting Temperature (° C.) | Number Average Molecular Weight |
| Sample | | | | | |
| 2-1 | (16) | 25*1 | 77 | 150° C. ≦ | 8,000 |
| 2-2 | (13) | 25 | 47 | 150° C. ≦ | 14,000–17,000 |
| 2-3 | (11) | 25 | 53 | 150° C. ≦ | 4,000 |
| 2-4 | (14) | 25 | 100 | 150° C. ≦ | 10,000 |
| 2-5 | (7) | 25 | 67 | 150° C. ≦ | 15,000–20,000 |
| 2-6 | (12) | 25 | 72 | 150° C. ≦ | 20,000–25,000 |
| 2-7 | (7) | 60 | 67 | 150° C. ≦ | 15,000–20,000 |
| 2-8 | (7) | 20 | 67 | 150° C. ≦ | 15,000–20,000 |
| 2-9 | (7) | 40 | 67 | 150° C. ≦ | 15,000–20,000 |
| 2-10 | (20) | 60*2 | 67 | 150° C. ≦ | 18,000 |
| 2-11 | (16) | 40*1 | 67 | 150° C. ≦ | 8,000 |

TABLE 4-continued

| Comparative Sample | | | | | |
|---|---|---|---|---|---|
| 2-1 | (17) | 25*3 | — | 75° C. | — |
| 2-2 | — | — | — | — | — |
| 2-3 | — | — | — | — | — |
| 2-4 | — | — | — | — | — |
| 2-5 | — | — | — | — | — |
| 2-6 | (7) | 70 | 67 | 150° C. ≦ | 15,000–20,000 |
| 2-7 | (8) | 70 | — | 75° C. | — |
| 2-8 | (8) | 70 | — | 75° C. | — |
| 2-9 | — | — | — | — | — |
| 2-10 | — | — | — | — | — |
| 2-11 | (13) | 25 | 47 | 150° C. ≦ | 14,000–17,000 |
| 2-12 | (13) | 25 | 47 | 150° C. ≦ | 14,000–17,000 |
| 2-13 | (7) | 25 | 67 | 150° C. ≦ | 15,000–20,000 |
| 2-14 | (7) | 25 | 67 | 150° C. ≦ | 15,000–20,000 |
| 2-15 | (18) | 25*1 | −10 | 110° C. | 15,000–20,000 |
| 1-16 | (13) | 25 | 47 | 150° C. ≦ | 14,000–17,000 |

| | Carbon Black Solvent | | | | |
|---|---|---|---|---|---|
| | Kind | Parts by Weight | Kind | Parts by Weight | Application Amount ($g/m^2$) |
| Sample | | | | | |
| 2-1 | — | — | Water | 900 | 0.5 |
| 2-2 | — | — | Toluene | 900 | 0.5 |
| 2-3 | — | — | Toluene | 900 | 0.5 |
| 2-4 | — | — | Toluene | 900 | 0.5 |
| 2-5 | — | — | Toluene | 900 | 0.5 |
| 2-6 | — | — | Toluene | 900 | 0.5 |
| 2-7 | (9) | 20 | Toluene | 900 | 0.5 |
| 2-8 | (9) | 20 | Toluene | 900 | 0.5 |
| 2-9 | (9) | 40 | Toluene | 900 | 0.5 |
| 2-10 | — | — | Water | 900 | 0.5 |
| 2-11 | (21) | 20*1 | Water | 900 | 0.5 |
| Comparative Sample | | | | | |
| 2-1 | — | — | Water | 900 | 0.5 |
| 2-2 | — | — | Toluene | 900 | 1.0 |
| 2-3 | — | — | Toluene | 900 | 1.0 |
| 2-4 | — | — | Toluene | 900 | 1.0 |
| 2-5 | — | — | Toluene | 900 | 1.0 |
| 2-6 | — | — | Toluene | 900 | 0.5 |
| 2-7 | — | — | Toluene | 900 | 1.0 |
| 2-8 | — | — | Toluene | 900 | 1.0 |
| 2-9 | — | — | Toluene | 900 | 1.0 |
| 2-10 | — | — | Toluene | 900 | 2.0 |
| 2-11 | — | — | Toluene | 900 | 0.5 |
| 2-12 | — | — | Toluene | 900 | 0.5 |
| 2-13 | — | — | Toluene | 900 | 0.5 |
| 2-14 | — | — | Toluene | 900 | 0.5 |
| 2-15 | — | — | Water | 900 | 0.5 |
| 2-16 | — | — | Toluene | 900 | 0.5 |

*Note 1: The binder resins (16) MD-1500 and (18) MD-1930 are a water dispersion liquid of a polyester resin, used with an appropriate amount so as to have the solid component by the predetermined parts by weight.

*Note 2: The binder resin (20) is a water dispersion liquid with a carbon black dispersed according to a method mentioned in the specification, used with an appropriate amount so as to have the solid component by 25 parts by weight.

*Note 3: The binder resin (17) is used with an appropriate amount so as to have the solid component of the carnauba wax by 25 parts by weight.

*Note 4: FUJI SP-Black 8556 is a water dispersion liquid of a carbon black, used with an appropriate amount so as to have the solid component by 20 parts by weight.

The kinds of the used thermally fusible substance, binder resin, and carbon black are as follows:

(1) Polyethylene glycol #4000 (produced by Sanyo Chemical Corp.)

(2) PLACCEL 210 (polycaprolactone diol, produced by Daicel Chemical Industries, Ltd.)

(3) PLACCEL 220 (polycaprolactone diol, produced by Daicel Chemical Industries, Ltd.)

(4) PLACCEL 240 (polycaprolactone diol, produced by Daicel Chemical Industries, Ltd.)

(5) PLACCEL H1P (polycaprolactone, produced by Daicel Chemical Industries, Ltd.)

(6) PLACCEL 320 (polycaprolactone triol, produced by Daicel Chemical Industries, Ltd.)

(7) VYLON 200 (produced by Toyoboseki Co., Ltd.)

(8) Carnauba No. 2 (carnauba wax, produced by Noda Wax)
(9) Carbon black (average particle size 40 nm, produced by Mitsubishi Chemical Corp.)
(10) PLACCEL 205 (polycaprolactone diol, produced by Daicel Chemical Industries, Ltd.)
(11) VYLON 220 (produced by Toyoboseki Co., Ltd.)
(12) VYLON 290 (produced by Toyoboseki Co., Ltd.)
(13) VYLON 600 (produced by Toyoboseki Co., Ltd.)
(14) Polystyrene (number average molecular weight 10,000)
(15) PLACCEL H7 (polycaprolactone, produced by Daicel Chemical Industries, Ltd.)
(16) VYLONAL MD-1500 (polyester water dispersion liquid, produced by Toyoboseki Co., Ltd.)
(17) Carnauba wax water dispersion liquid (produced by Konishi corp.)
(18) VYLONAL MD-1930 (polyester water dispersion liquid, produced by Toyoboseki Co., Ltd.)
(19) Dicyclohexyl phthalate
(20) Water dispersion of a carbon black dispersed polyester resin
(21) FUJI SP-Black 8556 (carbon black water dispersion, produced by Fuji Shikiso Corp.)

The water dispersion of the binder resin (20) shown in Table 4 was prepared by the following method. 100 parts by weight of a polyester resin having a 18,000 number average molecular weight with the following composition, 400 parts by weight of toluene, 50 parts by weight of a carbon black (average particle size 40 nm) produced by Mitsubishi Chemical Corp., and 5 parts by weight of a dispersing agent (SOLSPERS 24000) were dispersed with a sand mill by an ordinary method to a sufficiently stable state, and the toluene was eliminated by heat drying so as to prepare a carbon black dispersion to a polyester resin.

<Composition of the Polyester Resin>

Terephthalic acid:isophthalic acid:5-sodium sulfoisophthalate:ethylene glycol:neopentyl glycol=50:43:7:50:50 (molar ratio).

After sufficiently agitating 30 parts by weight of the above-mentioned carbon black dispersion to the polyester resin and 21 parts by weight of butyl cellosolve while heating at 150° C. so as to be kneaded like a thick malt syrup, 49 parts by weight of water heated preliminarily to 80° C. was dropped thereto by a small amount each time while strongly agitated by a high speed homogenizer. After finishing the dropping operation of the water, by gradually lowering the container temperature while continuing the strong agitation to the room temperature, a polyester resin water dispersion, with the carbon black dispersed mainly in the polyester resin phase was obtained.

Production of Comparative Samples 2-1 to 2-16

In the same process as the above-mentioned samples 2-1 to 2-11 except that an intermediate layer coating liquid with the composition shown in Table 4 were used with the application amount each shown in Table 4, thermal transfer films (comparative samples 2-1 to 2-16) were produced.

The thermal transfer films obtained as mentioned above (samples 2-1 to 2-11, and comparative samples 2-1 to 2-16) were evaluated for the coating suitability of the intermediate layer, the coating suitability of the coloring layer, the printing quality and the classification leakage preventing property by the same evaluation method as in the example 1.

<Evaluation Result>

Evaluation results are shown in Table 5.

TABLE 5

| | Coating Suitability of Intermediate layer | Coating Suitability of Coloring Layer | Printing Quality | classification leakage preventing property |
|---|---|---|---|---|
| | | Sample | | |
| 2-1 | A | A | A | C |
| 2-2 | B | A | A | C |
| 2-3 | B | A | A | C |
| 2-4 | A | A | B | C |
| 2-5 | A | A | A | C |
| 2-6 | A | A | A | C |
| 2-7 | A | A | A | B |
| 2-8 | A | A | A | B |
| 2-9 | A | A | A | A |
| 2-10 | A | A | A | A |
| 2-11 | A | A | B | B |
| | | Comparative Sample | | |
| 2-1 | C | C | D | C |
| 2-2 | C | C | D | C |
| 2-3 | C | C | D | C |
| 2-4 | C | B | D | C |
| 2-5 | C | C | D | C |
| 2-6 | A | A | D | C |
| 2-7 | C | C | D | C |
| 2-8 | C | C | D | C |
| 2-9 | C | B | D | C |
| 2-10 | C | B | D | C |
| 2-11 | C | C | C | C |
| 2-12 | C | C | C | C |
| 2-13 | B | C | C | C |
| 2-14 | B | A | C | C |
| 2-15 | C | C | C | C |
| 2-16 | C | C | C | C |

As shown in Table 5, it is confirmed that the thermal transfer films (samples 2-1 to 2-11) using a thermally fusible substance having a 100 mPa·s to 1,000 mPa·s melt viscosity at 75° C., and a binder resin having a 130° C. or more and 400° C. or less extrapolation fuse starting temperature, with the crystallization peak temperature (the crystallization peak temperature defined in the JIS K7121-1987) of the thermally fusible substance lower than the fuse peak temperature (the fuse peak temperature defined in the JIS K7121-1987) by 10° C. to 50° C. are at the level sufficient for the practical use in all of the items including the coating suitability of the intermediate layer, the coating suitability of the coloring layer, and the printing quality, and further, that the thermal transfer films (samples 2-7 to 2-11) containing a carbon black in the intermediate layer have also the excellent classification leakage preventing property.

In contrast, the thermal transfer films (comparative samples 2-3, 2-4, 2-6, 2-7, and 2-9 to 2-14) using a thermally fusible substance having a melt viscosity outside the range of 100 mPa·s to 1,000 mPa·s at 75° C., the thermal transfer films (comparative samples 2-2 to 2-5, 2-9, and 2-10) not containing a binder resin in the intermediate layer, the thermal transfer films (comparative samples 2-1, 2-7, 2-8, and 2-15) containing a binder resin having an extrapolation fuse starting temperature less than 150° C., and the thermal transfer film (comparative sample 2-16) having the value obtained by subtracting the crystallization peak temperature of the thermally fusible substance contained in the intermediate layer from the fuse peak temperature is outside the range of 10° C. to 50° C. are not sufficient for the practical use at least in one item from the coating suitability of the intermediate layer, the coating suitability of the coloring layer, and the printing quality.

Then, with a test printer using a partial glaze type thermal head produced by Rohm Co., Ltd. (KF2008-GH14, applied voltage 24V), a printing operation was executed with the thermal transfer film produced as mentioned above (sample 2-9) onto a printer paper produced by Xerox Corp. (#4024, beck smoothness 32 seconds) at a 10 ms/line printing rate with 12 kinds of printing conditions according to combination of a peeling time and an applied energy shown in Table 6 (printing conditions B-1 to B-8, comparative printing conditions B-1 to B-4).

The applied energy was adjusted by optionally changing the length of the applied pulse, and the peeling time was adjusted by optionally changing the distance from the center position of the heat generating member of the thermal head to the peeling position.

Moreover, the printing quality evaluation was executed according to the evaluation standard used for the above-mentioned samples 2-1 to 2-11 and comparative samples 2-1 to 2-16.

<Evaluation Result>

Evaluation results are shown in Table 6.

TABLE 6

| | Peeling Time (sec.) | Applied Energy (mJ/mm$^2$) | Printing Quality |
|---|---|---|---|
| | Printing Condition | | |
| B-1 | 0.1 | 5 | B |
| B-2 | 0.1 | 15 | A |
| B-3 | 0.1 | 30 | A |
| B-4 | 0.1 | 40 | B |
| B-5 | 1.5 | 5 | B |
| B-6 | 1.5 | 15 | A |
| B-7 | 1.5 | 30 | A |
| B-8 | 1.5 | 40 | B |
| | Comparative Printing Condition | | |
| B-1 | 3 | 5 | D |
| B-2 | 3 | 15 | C |
| B-3 | 3 | 30 | C |
| B-4 | 3 | 40 | D |

As shown in Table 6, the printing quality of the ones printed by the printing conditions B-1 to B-8 with the time from recording the pixels to separating the thermal transfer film and the printer paper of 2 seconds or less have a good printing quality. Among them, those printed by the printing conditions B-2, B-3, B-6, and B-7 with the printing energy in the range of 10 to 35 mJ/mm$^2$ (have a particularly good printing quality.

In contrast, ones printed by the comparative printing conditions B-1 to B-4 with the time from recording the pixels to separating the thermal transfer film and the printer paper of more than 2 seconds have a poor printing quality. Among them, those printed by the comparative printing conditions B-1 and B-4 with the printing energy outside the range of 10 to 35 mJ/mm$^2$ have a particularly poor printing quality.

Example 3

Production of Samples 3-1 to 3-8

An intermediate layer coating liquid with the composition shown in Table 7 was coated on a substrate film comprising a 4.5 $\mu$m thickness polyethylene terephthalate film (produced by Toray Industries, Inc.) by a gravure coating method with the application amount each shown in Table 7. After drying the solvent by a 100° C. hot air, it was wound up. The melt viscosity was measured with the same measuring device and measuring conditions as in the example 1.

Then, a coloring layer coating liquid with the below-mentioned composition was applied on each intermediate layer by a hot melt coating method heated to 100° C. by a 4 $\mu$m thickness in the dry state so as to form a coloring layer for producing thermal transfer films (samples 3-1 to 3-8).

A heat resistant slipping layer coating liquid with the below-mentioned composition was applied by a roll coater and dried on the other surface of the substrate film so as to provide a heat resistant slipping layer preliminarily by a 0.1 $\mu$m thickness in the dry state.

<Coloring Layer Coating Liquid>

Carbon black (average particle size 40 nm, produced by Mitsubishi Chemical Corp.): 15 parts Ethylene-vinyl acetate copolymer (SUMITETO HC10 produced by Sumitomo Chemical Co., Ltd.): 9 parts Carnauba wax (Kato Yoko Corp.): 38 parts Paraffin wax (155° F., produced by Nihon Seiro Co., Ltd.): 38 parts <Heat Resistant Slipping Layer Coating Liquid>

Polyvinyl butyral resin (ESLEC BX-1 produced by Sekisui Chemical Co., Ltd.): 20 parts Talc (MICROACE L-1 produced by Nihon Talc Corp.): 30 parts Melamine resin fine particles (EPOSTAR S produced by Nihon Shokubai Chemical Industry Corp.): 30 parts Polyisocyanate (TAKENATE A-3 produced by Takeda Medicine Industries, Ltd.): 40 parts Toluene/methylethyl ketone (weight ratio 1/1): 900 parts

TABLE 7

| | Kind | Parts by Weight | Caprolactone Resin: Melt Viscosity (mPa's) (75° C.) | Number Average Molecular Weight | Fuse Peak Temperature (° C.) |
|---|---|---|---|---|---|
| | | | Sample | | |
| 3-1 | (2) | 75 | 330–400 | 2,000 | 53–55 |
| 3-2 | (1) | 75 | 110–130 | 1,000 | 46–48 |
| 3-3 | (2) | 75 | 330–400 | 2,000 | 53–55 |
| 3-4 | (2) | 75 | 330–400 | 2,000 | 53–55 |
| 3-5 | (2) | 75 | 330–400 | 2,000 | 53–55 |
| 3-6 | (2) | 20 | 330–400 | 2,000 | 53–55 |
| 3-7 | (2) | 60 | 330–400 | 2,000 | 53–55 |
| 3-8 | (2) | 20 | 330–400 | 2,000 | 53–55 |
| | | | Comparative Sample | | |
| 3-1 | (2) | 100 | 330–400 | 2,000 | 53–55 |
| 3-2 | (3) | 100 | 1450–1650 | 4,000 | 55–58 |
| 3-3 | (4) | 100 | 250,000–300,000 | 10,000 | 60 |
| 3-4 | (5) | 100 | 200–400 | 2,000 | 40–45 |
| 3-5 | (4) | 30 | 250,000–300,000 | 10,000 | 60 |
| 3-6 | (4) | 30 | 250,000–300,000 | 10,000 | 60 |
| 3-7 | (2) | 30 | 330–400 | 2,000 | 53–55 |
| 3-8 | (4)/(3) = 2/1 | 100 | 200,000–250,000 | 8,000 | 60 |
| 3-9 | (14) | 100 | 2,000,000–2,500,000 | 70,000 | 60 |
| 3-10 | (9) | 75 | 30–50 | 530 | 30–40 |
| 3-11 | (3) | 75 | 1450–1650 | 4,000 | 55–58 |

TABLE 7-continued

| | Kind | Parts by Weight | | | |
|---|---|---|---|---|---|
| 3-12 | (9) | 75 | 30–50 | 530 | 30–40 |
| 3-13 | (3) | 75 | 1450–1650 | 4,000 | 55–58 |

| | Binder Resin | | | | |
|---|---|---|---|---|---|
| | | | Intermediate Glass Transitional temperature (° C.) | Softening Temperature (° C.) | Number Average Molecular Weight |
| | | | Sample | | |
| 3-1 | (11) | 25 | 47 | 155° C. | 14,000–17,000 |
| 3-2 | (10) | 25 | 72 | 180° C. | 20,000–25,000 |
| 3-3 | (12) | 25 | 100 | 180° C. | 10,000 |
| 3-4 | (6) | 25 | 67 | 163° C. | 15,000–20,000 |
| 3-5 | (10) | 25 | 72 | 180° C. | 20,000–25,000 |
| 3-6 | (6) | 60 | 67 | 163° C. | 15,000–20,000 |
| 3-7 | (6) | 20 | 67 | 163° C. | 15,000–20,000 |
| 3-8 | (6) | 40 | 67 | 163° C. | 15,000–20,000 |
| | | | Comparative Sample | | |
| 3-1 | — | — | — | — | — |
| 3-2 | — | — | — | | |
| 3-3 | — | — | — | | |
| 3-4 | — | — | — | | |
| 3-5 | (6) | 70 | 67 | 163° C. | 15,000–20,000 |
| 3-6 | (7) | 70 | — | 75° C. | |
| 3-7 | (7) | 70 | — | 75° C. | |
| 3-8 | — | — | — | | |
| 3-9 | — | — | — | | |
| 3-10 | (11) | 25 | 47 | 155° C. | 14,000–17,000 |
| 3-11 | (11) | 25 | 47 | 155° C. | 14,000–17,000 |
| 3-12 | (6) | 25 | 67 | 163° C. | 15,000–20,000 |
| 3-13 | (6) | 25 | 67 | 163° C. | 15,000–20,000 |

| | Carbon Black Solvent | | | | |
|---|---|---|---|---|---|
| | | | Kind | Parts by Weight | Application Amount (g/m$^2$) |
| | | | Sample | | |
| 3-1 | — | — | Toluene | 900 | 0.5 |
| 3-2 | — | — | Toluene | 900 | 0.5 |
| 3-3 | — | — | Toluene | 900 | 0.5 |
| 3-4 | — | — | Toluene | 900 | 0.5 |
| 3-5 | — | — | Toluene | 900 | 0.5 |
| 3-6 | (8) | 20 | Toluene | 900 | 0.5 |
| 3-7 | (8) | 20 | Toluene | 900 | 0.5 |
| 3-8 | (8) | 40 | Toluene | 900 | 0.5 |
| | | | Comparative Sample | | |
| 3-1 | — | — | Toluene | 900 | 1.0 |
| 3-2 | — | — | Toluene | 900 | 1.0 |
| 3-3 | — | — | Toluene | 900 | 1.0 |
| 3-4 | — | — | Toluene | 900 | 1.0 |
| 3-5 | — | — | Toluene | 900 | 0.5 |
| 3-6 | — | — | Toluene | 900 | 1.0 |
| 3-7 | — | — | Toluene | 900 | 1.0 |
| 3-8 | — | — | Toluene | 900 | 1.0 |
| 3-9 | — | — | Toluene | 900 | 2.0 |
| 3-10 | — | — | Toluene | 900 | 0.5 |
| 3-11 | — | — | Toluene | 900 | 0.5 |
| 3-12 | — | — | Toluene | 900 | 0.5 |
| 3-13 | — | — | Toluene | 900 | 0.5 |

The kinds of the used polycaprolactone resin, binder resin, and carbon black are as follows:

(1) PLACCEL 210 (polycaprolactone diol, produced by Daicel Chemical Industries, Ltd.)
(2) PLACCEL 220 (polycaprolactone diol, produced by Daicel Chemical Industries, Ltd.)
(3) PLACCEL 240 (polycaprolactone diol, produced by Daicel Chemical Industries, Ltd.)
(4) PLACCEL H1P (polycaprolactone, produced by Daicel Chemical Industries, Ltd.)
(5) PLACCEL 320 (polycaprolactone triol, produced by Daicel Chemical Industries, Ltd.)
(6) VYLON 200 (produced by Toyoboseki Co., Ltd.)
(7) Carnauba No. 2 (carnauba wax, produced by Noda Wax)
(8) Carbon black (average particle size 40 nm, produced by Mitsubishi Chemical Corp.)
(9) PLACCEL 205 (polycaprolactone diol, produced by Daicel Chemical Industries, Ltd.)
(10) VYLON 290 (produced by Toyoboseki Co., Ltd.)
(11) VYLON 600 (produced by Toyoboseki Co., Ltd.)
(12) Polystyrene (number average molecular weight 10,000)
(13) PLACCEL H7 (polycaprolactone, produced by Daicel Chemical Industries, Ltd.).

Production of Comparative Samples 3-1 to 3-13

In the same process as the above-mentioned samples 3-1 to 3-8 except that an intermediate layer coating liquid with the composition shown in Table 7 were used with the application amount each shown in Table 7, thermal transfer films (comparative samples 3-1 to 3-13) were produced.

The thermal transfer films obtained as mentioned above (samples 3-1 to 3-8, and comparative samples 3-1 to 3-13) were evaluated for the coating suitability of the intermediate layer, the coating suitability of the coloring layer, the printing quality and the classification leakage preventing property by the same evaluation method as in the example 1.

<Evaluation Result>

Evaluation results are shown in Table 8.

TABLE 8

| | Coating Suitability of Intermediate layer | Coating Suitability of Coloring Layer | Printing Quality | classification leakage preventing property |
|---|---|---|---|---|
| | | Sample | | |
| 3-1 | B | A | A | C |
| 3-2 | B | A | A | C |
| 3-3 | A | A | B | C |
| 3-4 | A | A | A | C |
| 3-5 | A | A | A | C |
| 3-6 | A | A | A | B |
| 3-7 | A | A | A | B |
| 3-8 | A | A | A | A |
| | | Comparative Sample | | |
| 3-1 | C | C | D | C |
| 3-2 | C | C | D | C |
| 3-3 | C | B | D | C |
| 3-4 | C | C | D | C |
| 3-5 | A | A | D | C |
| 3-6 | C | C | D | C |
| 3-7 | C | C | D | C |
| 3-8 | C | B | D | C |
| 3-9 | C | B | D | C |
| 3-10 | C | C | C | C |
| 3-11 | C | C | C | C |
| 3-12 | B | C | C | C |
| 3-13 | B | A | C | C |

As shown in Table 8, it is confirmed that the thermal transfer films (samples 3-1 to 3-8) using a polycaprolactone resin having a 100 mPa·s to 1,000 mPa·s melt viscosity at 75° C., and a non-transferable binder resin having a 130° C. or more and 400° C. or less softening temperature (the softening temperature measured by the ring and ball method defined in the JIS K2207-1980) are at the level sufficient for the practical use in all of the items including the coating suitability of the intermediate layer, the coating suitability of the coloring layer, and the printing quality, and further, that the thermal transfer films (samples 3-6, 3-7, and 3-8) containing a carbon black in the intermediate layer have also the excellent classification leakage preventing property.

In contrast, the thermal transfer films (comparative samples 3-2, 3-3, 3-5, 3-6, and 3-8 to 3-13) using a polycaprolactone resin having a melt viscosity outside the range of 100 mPa·s to 1,000 mPa·s at 75° C., the thermal transfer films (comparative samples 3-1 to 3-4, 3-8, and 3-9) not containing a binder resin in the intermediate layer, and the thermal transfer films (comparative samples 3-6 and 3-7) containing a binder resin having a softening temperature (the softening temperature measured by the ring and ball method defined in the JIS K2207-1980) less than 130° C. are not sufficient for the practical use at least in one item from the coating suitability of the intermediate layer, the coating suitability of the coloring layer, and the printing quality.

Then, with a test printer using a thermal head produced by Rohm Co., Ltd. (KF2008-GR10A, applied voltage 24V), a printing operation was executed with the thermal transfer film produced as mentioned above (sample 3-8) onto a printer paper produced by Xerox Corp. (#4024, beck smoothness 32 seconds) at a 10 ms/line printing rate with 16 kinds of printing conditions according to combination of a peeling time and an applied energy shown in Table 9 (printing conditions C-1 to C-8, comparative printing conditions C-1 to C-8).

The applied energy was adjusted by optionally changing the length of the applied pulse, and the peeling time was adjusted by optionally changing the distance from the center position of the heat generating member of the thermal head to the peeling position.

Moreover, the printing quality evaluation was executed according to the evaluation standard used for the above-mentioned samples 3-1 to 3-8 and comparative samples 3-1 to 3-13.

<Evaluation Result>

Evaluation results are shown in Table 9.

TABLE 9

| | Peeling Time (sec.) | Applied Energy (mJ/mm$^2$) | Printing Quality |
|---|---|---|---|
| | Printing Condition | | |
| C-1 | 0.1 | 5 | B |
| C-2 | 0.1 | 15 | A |
| C-3 | 0.1 | 30 | A |
| C-4 | 0.1 | 40 | B |
| C-5 | 1.5 | 5 | B |
| C-6 | 1.5 | 15 | A |
| C-7 | 1.5 | 30 | A |
| C-8 | 1.5 | 40 | B |
| | Comparative Printing Condition | | |
| C-1 | 0.02 | 5 | D |
| C-2 | 0.02 | 15 | C |
| C-3 | 0.02 | 30 | C |
| C-4 | 0.02 | 40 | D |
| C-5 | 3 | 5 | D |
| C-6 | 3 | 15 | C |
| C-7 | 3 | 30 | C |
| C-8 | 3 | 40 | D |

As shown in Table 9, the printing quality of the ones printed by the printing conditions C-1 to C-8 with the time from recording the pixels to separating the thermal transfer film and the printer paper in the range of 0.05 to 2 seconds have a good printing quality. Among them, those printed by the printing conditions C-2, C-3, C-6, and C-7 with the printing energy in the range of 10 to 35 mJ/mm$^2$ have a particularly good printing quality.

In contrast, ones printed by the comparative printing conditions C-1 to C-8 with the time from recording the pixels to separating the thermal transfer film and the printer paper of less than 0.05 second or more than 2 seconds have a poor printing quality. Among them, those printed by the comparative printing conditions C-1, C-4, C-5, and C-8 with the printing energy outside the range of 10 to 35 mJ/mm$^2$ have a particularly poor printing quality.

Example 4

Production of Samples 4-1 to 4-11

An intermediate layer coating liquid with the composition shown in Table 10 was coated on a substrate film comprising a 4.5 μm thickness polyethylene terephthalate film (produced by Toray Industries, Inc.) by a gravure coating method with the application amount each shown in Table 10. After drying the solvent by a 100° C. hot air, it was wound up. The melt viscosity was measured with the same measuring device and measuring conditions as in the example 1.

Then, a coloring layer coating liquid with the below-mentioned composition was applied on each intermediate layer by a hot melt coating method heated to 100° C. by a 4 μm thickness in the dry state so as to form a coloring layer for producing thermal transfer films (samples 4-1 to 4-11).

A heat resistant slipping layer coating liquid with the below-mentioned composition was applied by a roll coater and dried on the other surface of the substrate film so as to provide a heat resistant slipping layer preliminarily by a 0.1 μm thickness In the dry state.

<Coloring Layer Coating Liquid>

Carbon black (average particle size 40 nm, produced by Mitsubishi Chemical Corp.): 15 parts Ethylene-vinyl acetate copolymer (SUMITETO HC10 produced by Sumitomo Chemical Co., Ltd.): 9 parts Carnauba wax (Kato Yoko Corp.): 38 parts Paraffin wax (155° F., produced by Nihon Seiro Co., Ltd.): 38 parts <Heat Resistant Slipping Layer coating Liquid>

Polyvinyl butyral resin (ESLEC BX-1 produced by Sekisui Chemical Co., Ltd.): 20 parts Talc (MICROACE L-1 produced by Nihon Talc Corp.): 30 parts Melamine resin fine particles (EPOSTAR S produced by Nihon Shokubai Chemical Industry Corp.): 30 parts Polyisocyanate (TAKENATE A-3 produced by Takeda Medicine Industries, Ltd.): 40 parts Toluene/methylethyl ketone (weight ratio 1/1): 900 parts

TABLE 10

| | Thermally Fusible Substance | | | | | | |
|---|---|---|---|---|---|---|---|
| | Kind | Parts by Weight | Melt Viscosity (mPa · s) (75° C.) | Number Average Molecular Weight | A: Fuse Peak Temp. (° C.) | B: Crystallization Peak Temp. (° C.) | (A − B): Difference between A and B (° C.) (A − B) |
| Sample | | | | | | | |
| 4-1 | (1) | 75 | 250–300 | 4,000 | 57–58 | 32–34 | 23–26 |
| 4-2 | (3) | 75 | 330–400 | 2,000 | 53–55 | 27–29 | 24–28 |
| 4-3 | (2) | 75 | 110–130 | 1,000 | 46–48 | 20–22 | 24–28 |
| 4-4 | (3) | 75 | 330–400 | 2,000 | 53–55 | 27–29 | 24–28 |
| 4-5 | (3) | 75 | 330–400 | 2,000 | 53–55 | 27–29 | 24–28 |
| 4-6 | (3) | 75 | 330–400 | 2,000 | 53–55 | 27–29 | 24–28 |
| 4-7 | (3) | 20 | 330–400 | 2,000 | 53–55 | 27–29 | 24–28 |
| 4-8 | (3) | 60 | 330–400 | 2,000 | 53–55 | 27–29 | 24–28 |
| 4-9 | (3) | 20 | 330–400 | 2,000 | 53–55 | 27–29 | 24–28 |
| 4-10 | (1) | 40 | 250–300 | 4,000 | 57–58 | 32–34 | 23–26 |
| 4-11 | (1) | 40 | 180–220 | 4,000 | 57–58 | 32–34 | 23–26 |
| Comparative Sample | | | | | | | |
| 4-1 | (1) | 75 | 250–300 | 4,000 | 58–60 | 32–34 | 23–26 |
| 4-2 | (3) | 100 | 330–400 | 2,000 | 53–55 | 27–29 | 24–28 |
| 4-3 | (4) | 100 | 1450–1650 | 4,000 | 55–58 | 29–33 | 22–29 |
| 4-4 | (5) | 100 | 250,000–300,000 | 10,000 | 60 | 31–32 | 28–29 |
| 4-5 | (6) | 100 | 200–400 | 2,000 | 40–45 | 17–20 | 24–28 |
| 4-6 | (5) | 30 | 250,000–300,000 | 10,000 | 60 | 31–32 | 28–29 |
| 4-7 | (5) | 30 | 250,000–300,000 | 10,000 | 60 | 31–32 | 28–29 |
| 4-8 | (3) | 30 | 330–400 | 2,000 | 53–55 | 27–29 | 24–28 |
| 4-9 | (5)/(4) = 2/1 | 100 | 200,000–250,000 | 8,000 | 60 | 30–32 | 28–30 |
| 4-10 | (14) | 100 | 2,000,000–2,500,000 | 70,000 | 60 | 31–32 | 28–29 |
| 4-11 | (10) | 75 | 30–50 | 530 | 30–40 | 15–20 | 10–25 |
| 4-12 | (4) | 75 | 1450–1650 | 4,000 | 55–58 | 29–33 | 22–29 |
| 4-13 | (10) | 75 | 30–50 | 530 | 30–40 | 15–20 | 10–25 |
| 4-14 | (4) | 75 | 1450–1650 | 4,000 | 55–58 | 29–33 | 22–29 |
| 4-15 | (1) | 75 | 180–220 | 4,000 | 57–58 | 32–34 | 23–26 |
| 4-16 | (18) | 75 | 180–220 | 330 | 55–60 | −10–0 | 65–70 |

| | Binder Resin | | | | |
|---|---|---|---|---|---|
| | Kind | Solid component Parts by Weight | Intermediate Glass Transitional temperature (° C.) | Softening Temperature (° C.) | Number Average Molecular Weight |
| Sample | | | | | |
| 4-1 | (15) | 25*1 | 77 | 140° C. | 8,000 |
| 4-2 | (12) | 25 | 47 | 155° C. | 14,000–17,000 |
| 4-3 | (11) | 25 | 72 | 180° C. | 20,000–25,000 |
| 4-4 | (13) | 25 | 100 | 180° C. | 10,000 |
| 4-5 | (7) | 25 | 67 | 163° C. | 15,000–20,000 |
| 4-6 | (11) | 25 | 72 | 180° C. | 20,000–25,000 |
| 4-7 | (7) | 60 | 67 | 163° C. | 15,000–20,000 |
| 4-8 | (7) | 20 | 67 | 163° C. | 15,000–20,000 |
| 4-9 | (7) | 40 | 67 | 163° C. | 15,000–20,000 |
| 4-10 | (19) | 60*2 | 67 | 170° C. | 18,000 |
| 4-11 | (15) | 40*1 | 77 | 140° C. | 8,000 |
| Comparative Sample | | | | | |
| 4-1 | (16) | 25*3 | — | 75° C. | — |
| 4-2 | — | — | — | — | — |
| 4-3 | — | — | — | — | — |
| 4-4 | — | — | — | — | — |
| 4-5 | — | — | — | — | — |
| 4-6 | (7) | 70 | 67 | 163° C. | 15,000–20,000 |
| 4-7 | (8) | 70 | — | 75° C. | — |

TABLE 10-continued

| | | | | | |
|---|---|---|---|---|---|
| 4-8 | (8) | 70 | — | 75° C. | — |
| 4-9 | — | — | — | — | — |
| 4-10 | — | — | — | — | — |
| 4-11 | (12) | 25 | 47 | 155° C. | 14,000–17,000 |
| 4-12 | (12) | 25 | 47 | 155° C. | 14,000–17,000 |
| 4-13 | (7) | 25 | 67 | 163° C. | 15,000–20,000 |
| 4-14 | (7) | 25 | 67 | 163° C. | 15,000–20,000 |
| 4-15 | (17) | 25*1 | −10 | 110° C. | 15,000–20,000 |
| 4-16 | (12) | 25 | 47 | 155° C. | 14,000–17,000 |

| | Carbon Black | | Solvent | | |
|---|---|---|---|---|---|
| | Kind | Parts by Weight | Kind | Parts by Weight | Application Amount ($g/m^2$) |
| Sample | | | | | |
| 4-1 | — | — | Water | 900 | 0.5 |
| 4-2 | — | — | Toluene | 900 | 0.5 |
| 4-3 | — | — | Toluene | 900 | 0.5 |
| 4-4 | — | — | Toluene | 900 | 0.5 |
| 4-5 | — | — | Toluene | 900 | 0.5 |
| 4-6 | — | — | Toluene | 900 | 0.5 |
| 4-7 | (9) | 20 | Toluene | 900 | 0.5 |
| 4-8 | (9) | 20 | Toluene | 900 | 0.5 |
| 4-9 | (9) | 40 | Toluene | 900 | 0.5 |
| 4-10 | — | — | Water | 900 | 0.5 |
| 4-11 | (21) | 20*1 | Water | 900 | 0.5 |
| Comparative Sample | | | | | |
| 4-1 | — | — | Water | 900 | 0.5 |
| 4-2 | — | — | Toluene | 900 | 1.0 |
| 4-3 | — | — | Toluene | 900 | 1.0 |
| 4-4 | — | — | Toluene | 900 | 1.0 |
| 4-5 | — | — | Toluene | 900 | 1.0 |
| 4-6 | — | — | Toluene | 900 | 0.5 |
| 4-7 | — | — | Toluene | 900 | 1.0 |
| 4-8 | — | — | Toluene | 900 | 1.0 |
| 4-9 | — | — | Toluene | 900 | 1.0 |
| 4-10 | — | — | Toluene | 900 | 2.0 |
| 4-11 | — | — | Toluene | 900 | 0.5 |
| 4-12 | — | — | Toluene | 900 | 0.5 |
| 4-13 | — | — | Toluene | 900 | 0.5 |
| 4-14 | — | — | Toluene | 900 | 0.5 |
| 4-15 | — | — | Water | 900 | 0.5 |
| 4-16 | — | — | Toluene | 900 | 0.5 |

*Note 1: The binder resins (16) MD-1500 and (18) MD-1930 are a water dispersion liquid of a polyester resin, used with an appropriate amount so as to have the solid component by the predetermined parts by weight.

*Note 2: The binder resin (20) is a water dispersion liquid with a carbon black dispersed according to a method mentioned in the specification, used with an appropriate amount so as to have the solid component by 25 parts by weight.

*Note 3: The binder resin (17) is used with an appropriate amount so as to have the solid component of the carnauba wax by 25 parts by weight.

*Note 4: FUJI SP-Black 8556 is a water dispersion liquid of a carbon black, used with an appropriate amount so as to have the solid component by 20 parts by weight.

The kinds of the used thermally fusible substance, a binder resin, and carbon black are as follows:

(1) Polyethylene glycol #4000 (produced by Sanyo Chemical Corp.)
(2) PLACCEL 210 (polycaprolactone diol, produced by Daicel Chemical Industries, Ltd.)
(3) PLACCEL 220 (polycaprolactone diol, produced by Daicel Chemical Industries, Ltd.)
(4) PLACCEL 240 (polycaprolactone diol, produced by Daicel Chemical Industries, Ltd.)
(5) PLACCEL H1P (polycaprolactone, produced by Daicel Chemical Industries, Ltd.)
(6) PLACCEL 320 (polycaprolactone triol, produced by Daicel Chemical Industries, Ltd.)
(7) VYLON 200 (produced by Toyoboseki Co., Ltd.)
(8) Carnauba No. 2 (carnauba wax, produced by Noda Wax)
(9) Carbon black (average particle size 40 nm, produced by Mitsubishi Chemical Corp.)
(10) PLACCEL 205 (polycaprolactone diol, produced by Daicel Chemical Industries, Ltd.)
(11) VYLON 290 (produced by Toyoboseki Co., Ltd.)
(12) VYLON 600 (produced by Toyoboseki Co., Ltd.)
(13) Polystyrene (number average molecular weight 10,000)
(14) PLACCEL H7 (polycaprolactone, produced by Daicel Chemical Industries, Ltd.)
(15) VYLONAL MD-1500 (polyester water dispersion liquid, produced by Toyoboseki Co., Ltd.)
(16) Carnauba wax water dispersion liquid (produced by Konishi corp.)
(17) VYLONAL MD-1930 (polyester water dispersion liquid, produced by Toyoboseki Co., Ltd.)
(18) Dicyclohexyl phthalate
(19) Water dispersion of a carbon black dispersed polyester resin

(20) FUJI SP-Black 8556 (carbon black water dispersion, produced by Fuji Shikiso Corp.)

The water dispersion of the binder resin (19) shown in Table 10 was prepared by the following method. 100 parts by weight of a polyester resin having a 18,000 number average molecular weight with the following composition, 400 parts by weight of toluene, 50 parts by weight of a carbon black (average particle size 40 nm) produced by Mitsubishi Chemical Corp., and 5 parts by weight of a dispersing agent (SOLSPERS 24000) were dispersed with a sand mill by an ordinary method to a sufficiently stable state, and the toluene was eliminated by heat drying so as to prepare a carbon black dispersion to a polyester resin.

<Composition of the Polyester Resin>

Terephthalic acid:isophthalic acid:5-sodium sulfoisophthalate:ethylene glycol:neopentyl glycol=50:43:7:50:50 (molar ratio).

After sufficiently agitating 30 parts by weight of the above-mentioned carbon black dispersion to the polyester resin and 21 parts by weight of butyl cellosolve while heating at 150° C. so as to be kneaded like a thick malt syrup, 49 parts by weight of water heated preliminarily to 80° C. was dropped thereto by a small amount each time while strongly agitated by a high speed homogenizer. After finishing the dropping operation of the water, by gradually lowering the container temperature while continuing the strong agitation to the room temperature, a polyester resin water dispersion, with the carbon black dispersed mainly in the polyester resin phase was obtained.

Production of Comparative Samples 4-1 to 4-16

In the same process as the above-mentioned samples 4-1 to 4-11 except that an intermediate layer coating liquid with the composition shown in Table 10 were used with the application amount each shown in Table 10, thermal transfer films (comparative samples 4-1 to 4-16) were produced.

The thermal transfer films obtained as mentioned above (samples 4-1 to 4-11, and comparative samples 4-1 to 4-16) were evaluated for the coating suitability of the intermediate layer, the coating suitability of the coloring layer, the printing quality and the classification leakage preventing property by the same evaluation method as in the example 1.

<Evaluation Result>

Evaluation results are shown in Table 11.

TABLE 11

| | Coating Suitability of Intermediate layer | Coating Suitability of Coloring Layer | Printing Quality | Classification Leakage Preventing Property |
|---|---|---|---|---|
| | | Sample | | |
| 4-1 | A | A | A | C |
| 4-2 | B | A | A | C |
| 4-3 | B | A | A | C |
| 4-4 | A | A | B | C |
| 4-5 | A | A | A | C |
| 4-6 | A | A | A | C |
| 4-7 | A | A | A | B |
| 4-8 | A | A | A | B |
| 4-9 | A | A | A | A |
| 4-10 | A | A | A | A |
| 4-11 | A | A | B | B |
| | | Comparative Sample | | |
| 4-1 | C | C | D | C |
| 4-2 | C | C | D | C |
| 4-3 | C | C | D | C |
| 4-4 | C | B | D | C |

TABLE 11-continued

| | Coating Suitability of Intermediate layer | Coating Suitability of Coloring Layer | Printing Quality | Classification Leakage Preventing Property |
|---|---|---|---|---|
| 4-5 | C | C | D | C |
| 4-6 | A | A | D | C |
| 4-7 | C | C | D | C |
| 4-8 | C | C | D | C |
| 4-9 | C | B | D | C |
| 4-10 | C | B | D | C |
| 4-11 | C | C | C | C |
| 4-12 | C | C | C | C |
| 4-13 | B | C | C | C |
| 4-14 | B | A | C | C |
| 4-15 | C | C | C | C |
| 4-16 | C | C | C | C |

As shown in Table 11, it is confirmed that the thermal transfer films (samples 4-1 to 4-11) using a thermally fusible substance having a 100 mPa·s to 1,000 mPa·s melt viscosity at 75° C., and a non-transferable binder resin having a 130° C. or more and 400° C. or less softening temperature (the softening temperature measured by the ring and ball method defined in the JISK2207-1980), with the crystallization peak temperature (the crystallization peak temperature defined in the JIS K7121-1987) of the thermally fusible substance lower than the fuse peak temperature (the fuse peak temperature defined in the JIS K7121-1987) by 10° C. to 50° C. are at the level sufficient for the practical use in all of the items including the coating suitability of the intermediate layer, the coating suitability of the coloring layer, and the printing quality, and further, that the thermal transfer films (samples 4-7 to 4-11) containing a carbon black in the intermediate layer have also the excellent classification leakage preventing property.

In contrast, the thermal transfer films (comparative samples 4-3, 4-4, 4-6, 4-7, and 4-9 to 4-16) using a thermally fusible substance having a melt viscosity outside the range of 100 mPa·s to 1,000 mPa·s at 75° C., the thermal transfer films (comparative samples 4-2 to 4-5, 4-9, and 4-10) not containing a binder resin in the intermediate layer, the thermal transfer films (comparative samples 4-1, 4-7, 4-8, and 4-15) containing a binder resin having an softening temperature (the softening temperature measured by the ring and ball method defined in the JIS K2207-1980) less than 130° C., and the thermal transfer film (comparative sample 4-16) having the value obtained by subtracting the crystallization peak temperature of the thermally fusible substance contained in the intermediate layer from the fuse peak temperature is outside the range of 10° C. to 50° C. are not sufficient for the practical use at least in one item from the coating suitability of the intermediate layer, the coating suitability of the coloring layer, and the printing quality.

Then, with a test printer using a partial glaze type thermal head produced by Rohm Co., Ltd. (KF2008-GH14, applied voltage 24V), a printing operation was executed with the thermal transfer film produced as mentioned above (sample 4-9) onto a printer paper produced by Xerox Corp. (#4024, beck smoothness 32 seconds) at a 10 ms/line printing rate with 12 kinds of printing conditions according to combination of a peeling time and an applied energy shown in Table 12 (printing conditions D-1 to D-8, comparative printing conditions D-1 to D-4).

The applied energy was adjusted by optionally changing the length of the applied pulse, and the peeling time was adjusted by optionally changing the distance from the center position of the heat generating member of the thermal head to the peeling position.

Moreover, the printing quality evaluation was executed according to the evaluation standard used for the above-mentioned samples 4-1 to 4-11 and comparative samples 4-1 to 4-16.

<Evaluation Result>

Evaluation results are shown in Table 12.

TABLE 12

| | Peeling Time (sec.) | Applied Energy (mJ/mm$^2$) | Printing Quality |
|---|---|---|---|
| | Printing Condition | | |
| D-1 | 0.1 | 5 | B |
| D-2 | 0.1 | 15 | A |
| D-3 | 0.1 | 30 | A |
| D-4 | 0.1 | 40 | B |
| D-5 | 1.5 | 5 | B |
| D-6 | 1.5 | 15 | A |
| D-7 | 1.5 | 30 | A |
| D-8 | 1.5 | 40 | B |
| | Comparative Printing Condition | | |
| D-1 | 3 | 5 | D |
| D-2 | 3 | 15 | C |
| D-3 | 3 | 30 | C |
| D-4 | 3 | 40 | D |

As shown in Table 12, the printing quality of the ones printed by the printing conditions D-1 to D-8 with the time from recording the pixels to separating the thermal transfer film and the printer paper of 2 seconds or less have a good printing quality. Among them, those printed by the printing conditions D-2, D-3, D-6, and D-7 with the printing energy in the range of 10 to 35 mJ/mm$^2$ have a particularly good printing quality.

In contrast, ones printed by the comparative printing conditions D-1 to D-4 with the time from recording the pixels to separating the thermal transfer film and the printer paper of more than 2 seconds have a poor printing quality. Among them, those printed by the comparative printing conditions D-1, D-4 with the printing energy outside the range of 10 to 35 mJ/mm$^2$ have a particularly poor printing quality.

Example 5

Production of Samples 5-1 to 5-5

An intermediate layer coating liquid with the below-mentioned composition was coated on a substrate film comprising a 4.5 $\mu$m thickness polyethylene terephthalate film (produced by Toray Industries, Inc.) by a gravure coating method with a 0.5 g/m$^2$ application amount. After drying the solvent by a 100° C. hot air, it was wound up.

<Intermediate Layer Coating Liquid>

Polycaprolactone resin (PLACCEL 220 produced by Daicel Chemical Industries, Ltd.) (melt viscosity at 75° C.: 330 to 400 mPa·s; fuse peak temperature: 55° C.; number average molecular weight: 2,000): 20 parts Binder resin (polyester resin, VYLON 200 produced by Toyoboseki Co., Ltd.) (softening temperature: 163° C.; intermediate glass transitional temperature: 67° C.; number average molecular weight: 15,000 to 20,000): 60 parts Carbon black (average particle size 40 nm, produced by Mitsubishi Chemical Corp.): 20 parts Toluene: 900 parts Then, a coloring layer coating liquid (I to V) with the 5 kinds of compositions shown in Table 13 was applied on each intermediate layer by a hot melt coating method heated to 120° C. by a 4.5 $\mu$m thickness in the dry state so as to form a coloring layer for producing thermal transfer films (samples 5-1 to 5-5). Moreover, the melt viscosity of the coloring layer at 100° C. was measured and is shown in Table 13. The melt viscosity was measured with the following measuring device and the measuring conditions.

Device name: Viscoelasticity measuring device "Rotobisuco RV20" (Produced by HAKKE Corp.)

Measuring head part: M5

Sensor system: Sensor System Cone Plate PK5 (open angle 0.5°, cone plate radius 25 mm, set temperature 100° C.).

TABLE 13

| | Coloring Layer Coating Liquid | | | | |
|---|---|---|---|---|---|
| | (I) | (II) | (III) | (IV) | (V) |
| (1) Carbon Black | 18 parts | 18 parts | 18 parts | 18 parts | 18 parts |
| (2) Ethylene-vinyl acetate Copolymer | | | | | 11 parts |
| (3) Ethylene-vinyl acetate Copolymer | | | 11 parts | | |
| (4) Ethylene-vinyl acetate Copolymer | | 11 parts | | | |
| (5) Ethylene-vinyl acetate Copolymer | 11 parts | | | | |
| (6) Ethylene-vinyl acetate Copolymer | | | | 9 parts | |
| (7) Carnauba Wax | 10 parts | 10 parts | 10 parts | 10 parts | 10 parts |
| (8) Paraffin Wax | 61 parts | 61 parts | 61 parts | 61 parts | 61 parts |
| Melt Viscosity at 100° C. (mPa's) | 160 | 210 | 280 | 120 | 320 |

The materials used are as follows:

(1) Carbon black (average particle size 40 nm, produced by Mitsubishi Chemical Corp.)

(2) Ethylene-vinyl acetate copolymer (SUMITETO HA-10 produced by Sumitomo Chemical Co., Ltd.)

(3) Ethylene-vinyl acetate copolymer (SUMITETO DB-10, produced by Sumitomo Chemical Co., Ltd.)

(4) Ethylene-vinyl acetate copolymer (SUMITETO KC-10, produced by Sumitomo Chemical Co., Ltd.)

(5) Ethylene-vinyl acetate copolymer (SUMITETO HE-10, produced by Sumitomo Chemical Co., Ltd.)

(6) Ethylene-vinyl acetate copolymer (NUK-3160, produced by Nihon Yunika Corp.)

(7) Carnauba wax (Kato Yoko Corp.)

(8) Paraffin wax (paraffin wax-140, produced by Nihon Seiro Co., Ltd.)

A heat resistant slipping layer coating liquid with the below-mentioned composition was applied by a roll coater and dried on the other surface of the substrate film so as to provide a heat resistant slipping layer preliminarily by a 0.1 $\mu$m thickness in the dry state.

<Heat Resistant Slipping Layer Coating Liquid>

Polyvinyl butyral resin (ESLEC BX-1 produced by Sekisui Chemical Co., Ltd.): 20 parts Talc (MICROACE L-1 produced by Nihon Talc Corp.): 30 parts Melamine resin fine particles (EPOSTAR S produced by Nihon Shokubai Chemical Industry Corp.): 30 parts Polyisocyanate (TAKENATE A-3 produced by Takeda Medicine Industries, Ltd.): 40 parts Toluene/methylethyl ketone (weight ratio 1/1): 900 parts The thermal transfer films obtained as mentioned above (samples 5-1 to 5-5) were evaluated for the coating suitability of the intermediate layer, the coating suitability of the coloring layer, the printing quality and the classification leakage preventing property. The coating suitability of the intermediate layer, and the classification leakage preventing property were evaluated by the same evaluation method as in the example 1, and the coating suitability of the coloring layer, and the printing quality were evaluated by the following evaluation method.

<Coating Suitability of the Coloring Layer>

For the coating suitability at the time of applying a coloring layer coating liquid on the intermediate layer, the appearance of the coloring layer after coating was evaluated according to the following evaluation standard. For the observation, a stereomicroscope with a 10 to 20 magnification was used.

A: A stripe-like application irregularity is not observed with a stereomicroscope and an entirely homogeneous surface state without an application irregularity is obtained.

B: A stripe-like application irregularity is observed with a stereomicroscope and an entirely uneven surface state with an application irregularity is obtained.

C: A stripe-like application irregularity or a stripe-like region without applied with the coloring layer is observed in many places with naked eyes and an entirely uneven surface state is obtained.

<Printing Quality>

With a facsimile produced by Fuji Xerox Corp. (Telecopier 7033), a copy mode printing was executed onto a printer paper produced by Xerox Corp. (#4024, beck smoothness 32 seconds), using the above-mentioned thermal transfer films.

The obtained printed product was observed visually, and lack of characters or fine lines caused by a generated void was evaluated according to the following standard.

A: Lack of characters or fine lines caused by a generated void is hardly observed, and an extremely good printed product is obtained.

B: Although slight lack of characters or fine lines caused by a generated void is observed, a good printed product is obtained.

C: Lack of characters and fine lines caused by a generated void is observed considerably, and a printed product with characters and fine lines having a blurred appearance is obtained.

<Evaluation Result>

Evaluation results are shown in Table 14.

TABLE 14

| | Coloring Layer Coating Liquid | Evaluation Result | | | |
|---|---|---|---|---|---|
| | | Coating Suitability of Intermediate Layer | Coating Suitability of Coloring Layer | Printing Quality | Classification Leakage Preventing Property |
| Sample 5-1 | I | A | A | A | B |
| Sample 5-2 | II | A | A | A | B |

TABLE 14-continued

| | Coloring Layer Coating Liquid | Evaluation Result | | | |
|---|---|---|---|---|---|
| | | Coating Suitability of Intermediate Layer | Coating Suitability of Coloring Layer | Printing Quality | Classification Leakage Preventing Property |
| Sample 5-3 | III | A | A | A | B |
| Sample 5-4 | IV | A | A | B | B |
| Sample 5-5 | V | A | A | B | B |

As shown in Table 14, it is confirmed that the thermal transfer films (samples 5-1 to 5-3) using a coloring layer having a 150 mPa·s to 300 mPa·s melt viscosity at 100° C. have good results in all of the items including the coating suitability of the intermediate layer, the coating suitability of the coloring layer, the printing quality, and the classification leakage preventing property.

In contrast, although the thermal transfer films (samples 5-4 and 5-5) using a coloring layer having a melt viscosity outside the range of 150 mPa·s to 300 mPa·s at 100° C. have good results in the coating suitability of the intermediate layer, the coating suitability of the coloring layer, and the classification leakage preventing property, they are inferior to the above-mentioned thermal transfer films (samples 5-1 to 5-3) in terms of the printing quality.

Example 6

Production of Samples 6-1 to 6-5

An intermediate layer coating liquid with the below-mentioned composition was coated on a substrate film comprising a 4.5 μm thickness polyethylene terephthalate film (produced by Toray Industries, Inc.) by a gravure coating method with a 0.5 g/m$^2$ application amount. After drying the solvent by a 100° C. hot air, it was wound up.

<Intermediate Layer Coating Liquid>

Polycaprolactone resin (PLACCEL 220 produced by Daicel Chemical Industries, Ltd.) (melt viscosity at 75° C.: 330 to 400 mPa·s; fuse peak temperature: 55° C.; number average molecular weight: 2,000): 20 parts Binder resin (polyester resin, VYLON 200 produced by Toyoboseki Co., Ltd.) (softening temperature: 163° C.; intermediate glass transitional temperature: 67° C.; number average molecular weight: 15,000 to 20,000): 60 parts Carbon black (average particle size 40 nm, produced by Mitsubishi Chemical Corp.): 20 parts Toluene: 900 parts Then, a coloring layer coating liquid (I to V) with the 5 kinds of compositions shown in Table 15 was applied on each intermediate layer by a hot melt coating method heated to 120° C. by a 4.5 μm thickness in the dry state so as to form a coloring layer for producing thermal transfer films (samples 6-1 to 6-5). Moreover, the melt viscosity of the coloring layer at 100° C. was measured and is shown in Table 15. The melt viscosity was measured with the same measuring device and the measuring conditions as in the example 5. Furthermore, the fuse peak temperature of the coloring layer was measured according to the standard of the JIS K7121-1987, and is shown in Table 15. In the case a plurality of the fuse peak temperatures are observed, the peak with the largest heat absorption amount is shown as the fuse peak temperature.

TABLE 15

| | Coloring Layer Coating Liquid | | | | |
|---|---|---|---|---|---|
| | (I) | (II) | (III) | (IV) | (V) |
| (1) Carbon Black | 18 parts | 18 parts | 18 parts | 18 parts | 18 parts |
| (2) Ethylene-vinyl acetate Copolymer | 11 parts | 11 parts | 11 parts | 11 parts | 11 parts |
| (3) Carnauba Wax | 10 parts | 10 parts | 10 parts | 10 parts | 10 parts |
| (4) Paraffin Wax | | | | 61 parts | |
| (5) Paraffin Wax | 61 parts | | | | |
| (6) Paraffin Wax | | 61 parts | | | |
| (7) Paraffin Wax | | | 61 parts | | |
| (8) Paraffin Wax | | | | | 61 parts |
| Fuse Peak Temperature (° C.) | 51 | 55 | 59 | 43 | 70 |
| Melt Viscosity at 100° C. (mPa's) | 160 | 160 | 160 | 160 | 160 |

The materials used are as follows:

(1) Carbon black (average particle size 40 nm, produced by Mitsubishi Chemical Corp.)

(2) Ethylene-vinyl acetate copolymer (SUMITETO HE-10 produced by Sumitomo Chemical Co., Ltd.)

(3) Carnauba wax (Kato Yoko Corp.)

(4) Paraffin wax (SP-0110, produced by Nihon Seiro Co., Ltd.)

(5) Paraffin wax (FR-0120, produced by Nihon Seiro Co., Ltd.)

(6) Paraffin wax (SP-1030, produced by Nihon Seiro Co., Ltd.)

(7) Paraffin wax (SP-1035, produced by Nihon Seiro Co., Ltd.)

(8) Paraffin wax (SP-0160, produced by Nihon Seiro Co., Ltd.)

A heat resistant slipping layer coating liquid with the below-mentioned composition was applied by a roll coater and dried on the other surface of the substrate film so as to provide a heat resistant slipping layer preliminarily by a 0.1 μm thickness in the dry state.

<Heat Resistant Slipping Layer Coating Liquid>

Polyvinyl butyral resin (ESLEC BX-1 produced by Sekisui Chemical Co., Ltd.): 20 parts Talc (MICROACE L-1 produced by Nihon Talc Corp.): 30 parts Melamine resin fine particles (EPOSTAR S produced by Nihon Shokubai Chemical Industry Corp.): 30 parts Polyisocyanate (TAKENATE A-3 produced by Takeda Medicine Industries, Ltd.): 40 parts Toluene/methylethyl ketone (weight ratio 1/1): 900 parts The thermal transfer films obtained as mentioned above (samples 6-1 to 6-5) were evaluated for the coating suitability of the intermediate layer, the coating suitability of the coloring layer, the printing quality (void generation, entangle generation) and the classification leakage preventing property. The coating suitability of the intermediate layer, and the classification leakage preventing property were evaluated by the same evaluation method as in the example 1, and the coating suitability of the coloring layer, and the printing quality (void generation, entangle generation) were evaluated by the following evaluation method.

<Coating Suitability of the Coloring Layer>

For the coating suitability at the time of applying a coloring layer coating liquid on the intermediate layer, the appearance of the coloring layer after coating was evaluated according to the following evaluation standard. For the observation, a stereomicroscope with a 10 to 20 magnification was used.

A: A stripe-like application irregularity is not observed with a stereomicroscope and an entirely homogeneous surface state without an application irregularity is obtained.

B: A stripe-like application irregularity is observed with a stereomicroscope and an entirely uneven surface state with an application irregularity is obtained.

C: A stripe-like application irregularity or a stripe-like region without applied with the coloring layer is observed in many places with naked eyes and an entirely uneven surface state is obtained.

<Printing Quality (Void Generation)>

With a facsimile produced by Fuji Xerox Corp. (Telecopier 7033), a copy mode printing was executed onto a printer paper produced by Xerox Corp. (#4024, beck smoothness 32 seconds), using the above-mentioned thermal transfer films. In order to have the printing energy of the thermal head changeable to an optional value, a facsimile with the modification such that an optional voltage can be applied between the common electrode and the ground electrode of the thermal head mounted on the facsimile from the outside was used. Furthermore, as a document to be copied, a printed product with capital alphabets of an 8 point size (typeface courier) printed on a copy paper produced by Fuji Xerox (WR-100) by a printer produced by Oki Electric Co., Ltd. (MICROLINE 900 PSII LT) was used.

The printing operation was executed with the lowermost voltage capable of distinguishing the capital letters E and B at the time of copying the above-mentioned document by the thermal transfer films (samples 6-1 to 6-5). The printing result of the capital alphabets printed by the lowermost voltage was observed visually, and lack of characters or fine lines caused by a generated void was evaluated according to the following standard.

A: Lack of characters or fine lines caused by a generated void is hardly observed, and an extremely good printed product is obtained.

B: Although slight lack of characters or fine lines caused by a generated void is observed, a good printed product is obtained.

C: Lack of characters and fine lines caused by a generated void is observed considerably, and a printed product with characters and fine lines having a blurred appearance is obtained.

<Printing Quality (Entangle Generation)>

With a facsimile produced by Fuji Xerox Corp. (Telecopier 7033), a copy mode printing was executed onto a printer paper produced by Xerox Corp. (#4024, beck smoothness 32 seconds), using the above-mentioned thermal transfer films. In order to have the printing energy of the thermal head changeable to an optional value, a facsimile with the modification such that an optional voltage can be applied between the common electrode and the ground electrode of the thermal head mounted on the facsimile from the outside was used. Furthermore, as a document to be copied, a printed product with capital and lower-case alphabets of an 6 point size (typeface courier) printed on a copy paper produced by Fuji Xerox (WR-100) by a printer produced by Oki Electric Co., Ltd. (MICROLINE 900 PSII LT) was used.

The printing operation was executed with the lowermost voltage capable of distinguishing the capital letters E and B at the time of copying the above-mentioned document by the thermal transfer films (samples 6-1 to 6-5). The printing result of the lower-case alphabets printed by the lowermost voltage was observed visually, and generation of crush of characters caused by the entangle phenomenon was evaluated according to the following standard.

The "entangle phenomenon" in the present invention denotes the transfer state of the coloring layer of the thermal transfer film adhered like a thin film without sticking onto the surface of the surface of the transfer receiving material. Furthermore, the "crush" in the present invention denotes the state of a plurality of lines comprising characters linked by the transferred coloring layer.

AA: Crush of characters generated by entangle generation is not observed at all, and an extremely good printed product is obtained.

A: Crush of characters generated by entangle generation is hardly observed, and a good printed product is obtained.

B: Although crush of characters generated by entangle generation is slightly observed, a printed product with characters preferably distinguished is obtained.

C: Crush of characters generated by entangle generation is considerably observed, and a printed product with characters impossible to or difficult to distinguish is obtained.

<Evaluation Result>

Evaluation results are shown in Table 16.

TABLE 16

| | | Evaluation Result | | | | |
|---|---|---|---|---|---|---|
| | Coloring Layer Coating Liquid | Coating Suitability of Intermediate Layer | Coating Suitability of Coloring Layer | Printing Quality Q-1: Entangle | Printing Quality Q-2: Void | Classification Leakage Preventing Property |
| Sample 6-1 | I | A | A | A | A | B |
| Sample 6-2 | II | A | A | AA | A | B |
| Sample 6-3 | III | A | A | A | A | B |
| Sample 6-4 | IV | A | A | B | A | B |
| Sample 6-5 | V | A | A | B | B | B |

As shown in Table 16, it is confirmed that the thermal transfer films (samples 6-1 to 6-3) with a 10° C. or less difference between the fuse peak temperature of the coloring layer and the fuse peak temperature of the polycaprolactone resin (PLACCEL 220, produced by Daicel Chemical Industries, Ltd.) have good results in all of the items including the coating suitability of the intermediate layer, the coating suitability of the coloring layer, the printing quality, and the classification leakage preventing property.

In contrast, although the thermal transfer film (sample 6-4) with a more than 10° C. difference between the fuse peak temperatures has good results in the coating suitability of the intermediate layer, the coating suitability of the coloring layer, the printing quality (void) and the classification leakage preventing property, it is inferior to the above-mentioned thermal transfer films (samples 6-1 to 6-3) in terms of the printing quality (entangle).

Furthermore, the thermal transfer film (sample 6-5) with a difference between the fuse peak temperatures larger than that of the above-mentioned thermal transfer film (sample 6-4) is inferior to the above-mentioned thermal transfer films (samples 6-1 to 6-3) also in terms of the printing quality (void).

As heretofore mentioned, according to the present invention, the following effects can be provided.

(1) Since the melt viscosity of a polycaprolactone resin or a thermally fusible substance having the supercooling property is in an appropriate viscosity region, a thermal transfer film capable of providing a good print with little void generation can be obtained. Moreover, the thermal transfer film has a reduced peeling sound at the time of being peeled off from a transfer receiving material.

(2) Furthermore, an inconvenience of bonding of the intermediate layer surface of the thermal transfer film to the substrate film surface at the time of being wound up after the application can be solved.

(3) Moreover, at the time of applying a coloring layer onto a substrate film provided with an intermediate layer by the hot melt coating method, even if a polycaprolactone resin or a thermally fusible substance of the intermediate layer becomes a low viscosity liquid by the heat of a heated and fused coloring layer ink, the coloring layer ink can be overcoated stably with a good surface quality.

(4) Furthermore, by adding a carbon black to the intermediate layer, the content of the print can hardly be read out from the thermally transfer film after printing so that the classification leakage preventing effect can be provided.

(5) Moreover, since the melt viscosity at 100° C. of the coloring layer is 150 mPa·s or more and 300 mPa·s or less, and the difference between the fuse peak temperature of the coloring layer and the fuse peak temperature of the polycaprolactone resin or the thermally fusible substance is 10° C. or less, a thermal transfer film capable of providing a good print with further little void generation can be obtained.

What is claimed is:

1. A thermal transfer film comprising a coloring layer formed on a substrate film via an intermediate layer, wherein the intermediate layer contains a polycaprolactone resin having a 100 mPa·s or more and 1,000 mPa·s or less melt viscosity at 75° C., and a binder resin having a 130° C. or more and 400° C. or less extrapolation fuse starting temperature defined in the JIS K7121-1987.

2. A thermal transfer film according to claim 1, wherein the binder resin is incompatible to the polycaprolact one resin.

3. A thermal transfer film according to claim 1, wherein the fuse peak temperature defined in the JIS K7121-1987 of the polycaprolactone resin is 45° C. or more and 70° C. or less, and the intermediate glass transitional temperature defined in the JIS K7121-1987 of the binder resin is higher than the fuse peak temperature of the polycaprolactone resin by 2° C. or more.

4. A thermal transfer film according to claim 1, wherein the number average molecular weight of the binder resin is 8,000 or more and 1,000,000 or less.

5. A thermal transfer film according to claim 1, wherein the binder resin is a polyester resin.

6. A thermal transfer film according to claim 1, wherein the intermediate layer contains a carbon black.

7. A thermal transfer film according to claim 1, wherein the intermediate layer comprises a porous film comprising the binder resin and not to be thermally transferred, with the polycaprolactone resin contained in the pores of the porous film.

8. A thermal transfer film according to claim 7, wherein a carbon black is contained in the porous film.

9. A thermal transfer film according to claim 1, wherein the melt viscosity at 100° C. of the coloring layer is 150 mPa·s or more and 300 mPa·s or less.

10. A thermal transfer film according to claim 1, wherein difference between the fuse peak temperature defined in the JIS K7121-1987 of the coloring layer and the fuse peak temperature defined in the JIS K7121-1987 of the polycaprolactone resin is 10° C. or less.

11. An image forming method comprising the steps of superimposing a transfer receiving material onto the coloring layer surface of a thermal transfer film, heating and recording from the substrate film side like pixels by heating means, and separating the thermal transfer film and the transfer receiving material, wherein the thermal transfer film comprising a coloring layer formed on a substrate film via an intermediate layer, in which the intermediate layer contains a polycaprolactone resin having a 100 mPa·s or more and 1,000 mPa·s or less melt viscosity at 75° C., and a binder resin having a 130° C. or more and 400° C. or less extrapolation fuse starting temperature defined in the JIS K7121-1987 is used, and the time from recording the pixels to separating the thermal transfer film and the transfer receiving material is 0.05 second or more and 2 seconds or less.

12. An image forming method according to claim 11, wherein the heating means is a thermal head of an entire surface glaze or a partial glaze.

13. An image forming method according to claim 11, wherein the energy for heating and recording is 10 mJ/mm$^2$ or more and 35 mJ/mm$^2$ or less.

14. A thermal transfer film comprising a coloring layer formed on a substrate film via an intermediate layer, wherein the intermediate layer contains a polycaprolactone resin having a 100 mPa·s or more and 1,000 mPa·s or less melt viscosity at 75° C., and a non-transferable binder resin having a 130° C. or more and 400° C. or less softening temperature measured by the ring and ball method defined in the JIS K2207-1980.

15. A thermal transfer film according to claim 14, wherein the binder resin is incompatible to the polycaprolactone resin.

16. A thermal transfer film according to claim 14, wherein the fuse peak temperature defined in the JIS K7121-1987 of the polycaprolactone resin is 45° C. or more and 70° C. or less, and the intermediate glass transitional temperature defined in the JIS K7121-1987 of the binder resin is higher than the fuse peak temperature of the polycaprolactone resin by 2° C. or more.

17. A thermal transfer film according to claim 14, wherein the number average molecular weight of the binder resin is 8,000 or more and 1,000,000 or less.

18. A thermal transfer film according to claim 14, wherein the binder resin is a resin having a benzene ring structure.

19. A thermal transfer film according to claim 14, wherein the binder resin is a polyester resin.

20. A thermal transfer film according to claim 14, wherein the intermediate layer contains a carbon black.

21. A thermal transfer film according to claim 14, wherein the intermediate layer comprises a porous film comprising the binder resin and not to be thermally transferred, with the polycaprolactone resin contained in the pores of the porous film.

22. A thermal transfer film according to claim 21, wherein a carbon black is contained in the porous film.

23. A thermal transfer film according to claim 14, wherein the melt viscosity at 100° C. of the coloring layer is 150 mPa·s or more and 300 mPa·s or less.

24. A thermal transfer film according to claim 14, wherein the difference between the fuse peak temperature defined in the JIS K7121-1987 of the coloring layer and the fuse peak temperature defined in the JIS K7121-1987 of the polycaprolactone resin is 10° C. or less.

25. An image forming method comprising the steps of superimposing a transfer receiving material onto the coloring layer surface of a thermal transfer film, heating and recording from the substrate film side like pixels by heating means, and separating the thermal transfer film and the transfer receiving material, wherein thermal transfer film comprising a coloring layer formed on a substrate film via an intermediate layer, in which the intermediate layer contains a polycaprolactone resin having a 100 mPa·s or more and 1,000 mPa·s or less melt viscosity at 75° C., and a non-transferable binder resin having a 130° C. or more and 400° C. or less softening temperature measured by the ring and ball method defined in the JIS K2207-1980 is used, and the time from recording the pixels to separating the thermal transfer film and the transfer receiving material is 0.05 second or more and 2 seconds or less.

26. An image forming method according to claim 25, wherein the heating means is a thermal head of an entire surface glaze or a partial glaze.

27. An image forming method according to claim 25, wherein the energy for heating and recording is 10 mJ/mm$^2$ or more and 35 mJ/mm$^2$ or less.

* * * * *